US006966961B2

(12) United States Patent
Adami

(10) Patent No.: US 6,966,961 B2
(45) Date of Patent: Nov. 22, 2005

(54) SPLICING DEVICE FOR SPLICING TWO WEB MATERIALS TOGETHER, UNWINDER COMPRISING SAID SPLICING DEVICE AND RELATIVE METHOD

(75) Inventor: Mauro Adami, Lucca (IT)

(73) Assignee: Fosber, S.p.A., Lucca (IT)

( * ) Notice: Subject to any disclaimer, the term of this patent is extended or adjusted under 35 U.S.C. 154(b) by 0 days.

(21) Appl. No.: 10/668,160

(22) Filed: Sep. 24, 2003

(65) Prior Publication Data

US 2004/0084133 A1 May 6, 2004

(30) Foreign Application Priority Data

Sep. 25, 2002 (IT) ..... FI2002A0178

(51) Int. Cl.[7] ..... B65H 21/00

(52) U.S. Cl. ..... 156/159; 156/157; 156/502; 156/504; 242/553

(58) Field of Search ..... 156/157, 159, 156/502, 504, 505, 506; 242/551, 553, 556.1

(56) References Cited

U.S. PATENT DOCUMENTS

| | | | | |
|---|---|---|---|---|
| 3,841,944 | A * | 10/1974 | Harris, Jr. | 156/504 |
| 3,858,819 | A | 1/1975 | Butler, Jr. | |
| 5,171,396 | A * | 12/1992 | Rank et al. | 156/502 |
| 6,451,145 | B1 * | 9/2002 | Forbes | 156/159 |
| 6,701,992 | B1 * | 3/2004 | Pasquale et al. | 156/504 |
| 6,786,264 | B1 * | 9/2004 | Torres Martinez | 156/504 |
| 2002/0074087 | A1 * | 6/2002 | Hashimoto | 156/362 |

FOREIGN PATENT DOCUMENTS

| | | |
|---|---|---|
| EP | 0 341 605 A2 | 11/1989 |
| EP | 0 341 605 A3 | 11/1989 |
| EP | 0 341 642 A2 | 11/1989 |
| EP | 0 341 642 A3 | 11/1989 |
| EP | 0 378 721 B1 | 4/1996 |
| EP | 1 422 175 A2 | 5/2004 |
| GB | 1 569 886 | 6/1980 |

OTHER PUBLICATIONS

Brochure: M. Torres Diseños Industriales, S.A.; Constant Web Tension Splicer, Model LTS 590; Torres de Elorz-Navarra, Spain., date unknown.

Brochure: Peters Maschienenfabrik GMBH; The Roll Stands And The Splicer From Peters; Hamburg, Germany., date unknown.

Brochure: M. Torres Diseños Industriales, S.A.; Model CTS Splicer; Torres de Elorz-Navarra, Spain., date unknown.

Brochure: BHS-Werk Weiherhammer; Effective Innovation: BHS Modul Splicer ARW-M; Weiherhammer, Germany., date unknown.

Brochure: United Container Machinery; The Rollrunner Splicer; Glen Arm, Maryland, USA., date unknown.

* cited by examiner

*Primary Examiner*—Mark A. Osele
(74) *Attorney, Agent, or Firm*—Breiner & Breiner, L.L.C.

(57) ABSTRACT

The splicing device comprises two heads (41A, 43A; 41B, 43B), each of which has: a roller (33A; 33B) associated with a clamping bar (93A; 93B) to hold between said roller and said clamping bar an initial edge (L) of the second web material; a counter-pressure member (53A; 53B) cooperating with said roller to press said first and second web materials against each other; and a cutting member (67A; 67B).

26 Claims, 18 Drawing Sheets

( STATE OF THE ART )

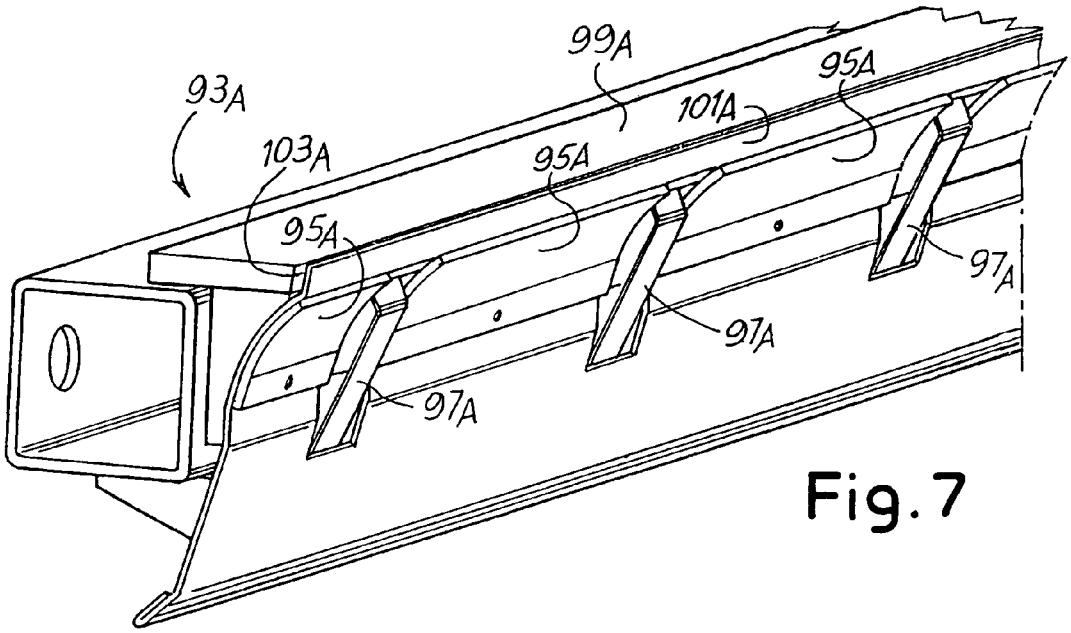
Fig. 7
Fig. 8
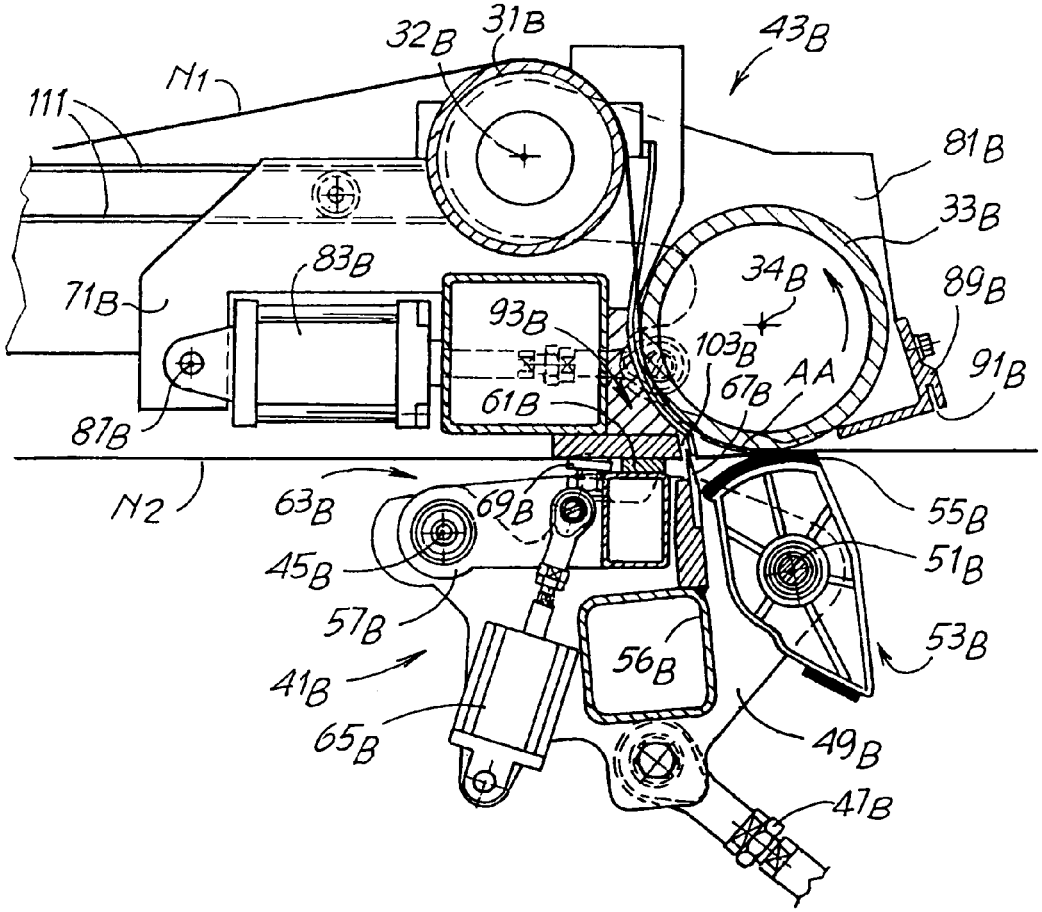

SPLICING DEVICE FOR SPLICING TWO WEB MATERIALS TOGETHER, UNWINDER COMPRISING SAID SPLICING DEVICE AND RELATIVE METHOD

TECHNICAL FIELD

The present invention relates to a device to splice two webs together, for example two sheets of cardboard, to allow continuous feed of a web material wound in reels towards a processing line, for example a machine to produce corrugated cardboard.

The invention also relates to an unwinding device in which reels of web material are unwound in succession, equipped with a splicing device to splice a first web material coming from a reel being unwound to the head or leading edge of a second web material coming from a standing by reel.

STATE OF THE ART

In many industrial applications, for example although not exclusively in the production of corrugated cardboard, a web material coming from a reel being unwound is fed towards a production line. In the case of corrugated cardboard, for example, the web material is fed to a so-called "single-facer" or to a so-called "double-facer" to be combined with other sheets of web material, if necessary after corrugation of the material.

To obtain continuous operation of the production line to which the web material is fed, the web material coming from a first reel of web material must be spliced to the web material coming from a second reel, for example when the first reel is coming to an end. This operation must preferably take place without reducing the feed speed of the material to the production line and in any case without stopping feed. Regular feed is particularly important in corrugated cardboard production lines, where the machines downstream of the unwinder work at high temperatures and in which the speed and regularity of feed are critical parameters to obtain a high quality finished product.

In order to join sheets of web material together in a rapid and reliable way, various devices have been produced.

U.S. Pat. No. 3,858,819 describes a device provided with two bars moving crosswise in relation to the direction of feed of the web material and to which the leading free edge of the web material of a supply reel standing by is alternately fixed. A double counter-blade, cooperating alternately with two cutting blades, is provided under the two bars. A first actuator for each assembly formed of bar and cutting blade causes a reciprocal drawing in movement of the bars to press the two web materials to be spliced against each other. Two actuators are also provided, one for each cutting blade, which are operated alternately to cut the web material which is running out.

The device described in U.S. Pat. No. 3,858,819 is complex and is not able to reach the high operating speeds required of these devices today.

A similar device, with analogous problems and limits, is described in EP-B-0,378,721.

GB-A-1,569,886 describes a splicing device in which the two web materials are spliced by reciprocal pressure between two rollers, with which a cutting blade is associated. This device is also complex due to the need to provide several actuators to control the various members of the splicing device. The speeds that can be reached are limited.

FIG. 1 schematically represents a head of a different prior art splicing device produced by BHS (Germany). This device comprises two heads similar to each other. The head shown in FIG. 1 comprises a roller 1 associated with a clamping bar 3. The leading edge L of the web material N2 coming from a waiting reel (not shown) is held between the roller 1 and the bar 3 and a double-sided adhesive strip BA is applied to it. The web material N1, coming from the reel (not shown) which is currently supplying the material to the production line, passes between the roller 1 and a second counter-pressure roller 5. A cutting blade 7 is positioned adjacent to the roller 5. Above the clamping bar 3 a brake 9 is provided to clamp the web material N1 at the moment in which the splice is to be made between the first and second web material.

To cut the web material N1 and splice it with the web material N2 the members 3, 5, 7 and 9 are provided with respective actuators (shown schematically in FIG. 1) which control the following operating sequence: the web material N1 is braked and clamped by lowering the brake 9 which presses against the upper surface of the bar 3; the roller 5 is lowered and pressed against the roller 1; the cutting blade 7 acts to cut the web N1 by being lowered towards the roller 1; the cutting blade 7, the clamping bar 3 and the brake 9 are withdrawn, moving away from the roller 1; the roller 1 and the roller 5 start to rotate in opposite directions to feed the web material N2, the leading edge L of which is spliced to the tail of the web material N1 produced by the cut made by the blade 7. Splicing is obtained by adhesion by means of a strip of double-sided adhesive tape applied previously to the edge L, thanks to the pressure exerted by the rollers 1, 5 on the web materials N1, N2 which are fed through the nip between the rollers.

The device in FIG. 1 is relatively fast, but extremely complex due to the numerous moving members provided with autonomous controls. The various movements must be coordinated and synchronized with one another. The short time available for splicing the web materials makes synchronization critical. This reduces the reliability of the device and in any case places a limit on the maximum admissible operating speed.

OBJECTS AND SUMMARY OF THE INVENTION

The object of the present invention is to produce a device to splice together two web materials, which overcomes the drawbacks of prior art devices and in particular is of simple construction, fast and reliable.

This and other objects and advantages, which shall become apparent to those skilled in the art by reading the text hereunder and from the accompanying drawings, is in substance obtained with a splicing device comprising two heads, each of which has: a roller associated with a clamping bar to hold between said roller and said clamping bar an leading edge of the second web material; a counter-pressure member cooperating with said roller to press said first and second web materials against each other; a cutting member; if necessary a braking means to brake the first web material. Characteristically, according to the invention, the counter-pressure member, the cutting member and the braking means if provided are carried by a moving unit controlled by an actuator which, through a movement imparted by it to said unit, causes clamping of the first web material through said braking means, nipping of the first and second web material between said roller and said counter-pressure member, cutting of the first web material by said cutting member and release of the second web material through a movement of said roller in respect of said clamping bar, the roller being pushed by said counter-pressure member.

The moving unit of each head of the splicing device may be provided for example with a translatory movement. Nonetheless, according to a particularly advantageous embodiment of the invention it is provided with an oscillatory movement around a first axis of oscillation, controlled by said actuator.

Advantageously, the counter-pressure member of each of said heads is supported by the moving unit oscillatingly around a second axis of oscillation, substantially parallel to said first axis of oscillation. Advantageously, it has a substantially cylindrical surface cooperating with the roller. In substance, the counter-pressure member does not require to be produced in the form of a roller, but may have an active surface constituted by a portion of a cylindrical surface. This greatly reduces its dimensions and allows the various members carried by the moving unit to be positioned close to one another. In particular, the cutting member is thus in an optimum position to cut the web material.

Further advantageous features and embodiments of the invention are indicated in the accompanying dependent claims.

Another object of the invention is an unwinder provided with a splicing device of the aforesaid type.

BRIEF DESCRIPTION OF THE DRAWINGS

The invention shall now be better understood by following the description and accompanying drawing showing a non-limiting practical embodiment of the invention. In greater detail in the drawing:

FIG. 7 shows a detail of the clamping bar of the web material against the roller associated with it to hold the head of the web material; and FIG. 8 shows an enlargement of the second head of the splicing device.

DETAILED DESCRIPTION OF A PREFERRED EMBODIMENT OF THE INVENTION

Figure 1:
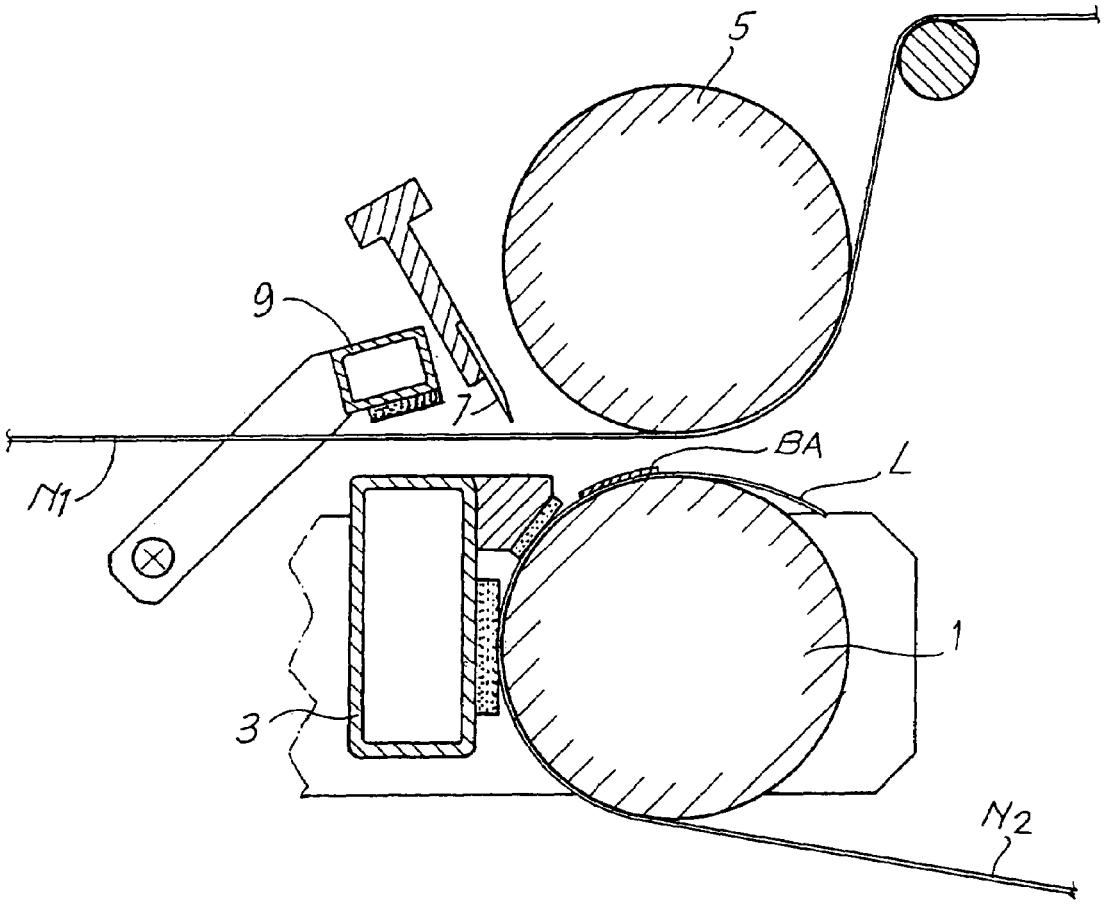
FIG. 1 (described hereinbefore) shows a device according to the state of the art.

FIGS. 2 to 5 show in different operating positions an unwinder to feed a web material to a processing line downstream, not shown. A splicing device according to the invention is combined with the unwinder.

The unwinder illustrated is particularly suitable to feed sheets or webs of cardboard to produce corrugated cardboard. The structure of the unwinder, indicated as a whole with 1, may be different from that show in the figures, the splicing device of the invention also being suitable for application in unwinders differing in arrangement.

In the example illustrated, the unwinder has a fixed structure with two pairs of uprights 3 (a single upright of each pair being visible in the drawing) and a pair of crosspieces 5 (of which one is visible in the drawing while the other is disposed behind it). The crosspieces 5 carry guides 7 for a pair of carriages or slides 9A and 9B. Each carriage 9A, 9B has engaging and lifting means 11A and 11B to engage and lift or lower reels of web material. In the example shown these means have vertical arms that extend telescopically with tailstocks that engage each reel axially penetrating from opposite parts of the winding core. The structure of the carriages or slides 9A, 9B and the means 11A, 11B for lifting and lowering the reels is not the specific object of the present invention and therefore shall not be described in detail herein. It must be understood, as indicated above, that the structure of the unwinder may also vary from the one illustrated; for example the reels may be handled by oscillating arms, in a per se known way. Moreover, the number of positions of the reels on the unwinder may be different to three, as shown in the example. For example, there may only be two reel loading, unloading and processing stations. As a non-limiting example, unwinders with various structures to which a splicing device according to the invention may be applied are described for example in EP-A-1127820, U.S. Pat. No. 3,858,819, JP-A-7157156, JP-A- 1111749, EP-A-968945, U.S. Pat. No. 4,919,353, U.S. Pat. No. 5,004,173.

The crosspieces 5 have at the top an assembly of rollers defining a supply or festoon of web material for the purposes described hereunder. This assembly of rollers comprises a first fixed roller 13 and a second fixed roller 15, and a pair of rollers 17 and 19 with moving axis, carried by a carriage 21 sliding according to the arrow f21 along a guide 23 carried by the crosspieces 25.

Figure 2:
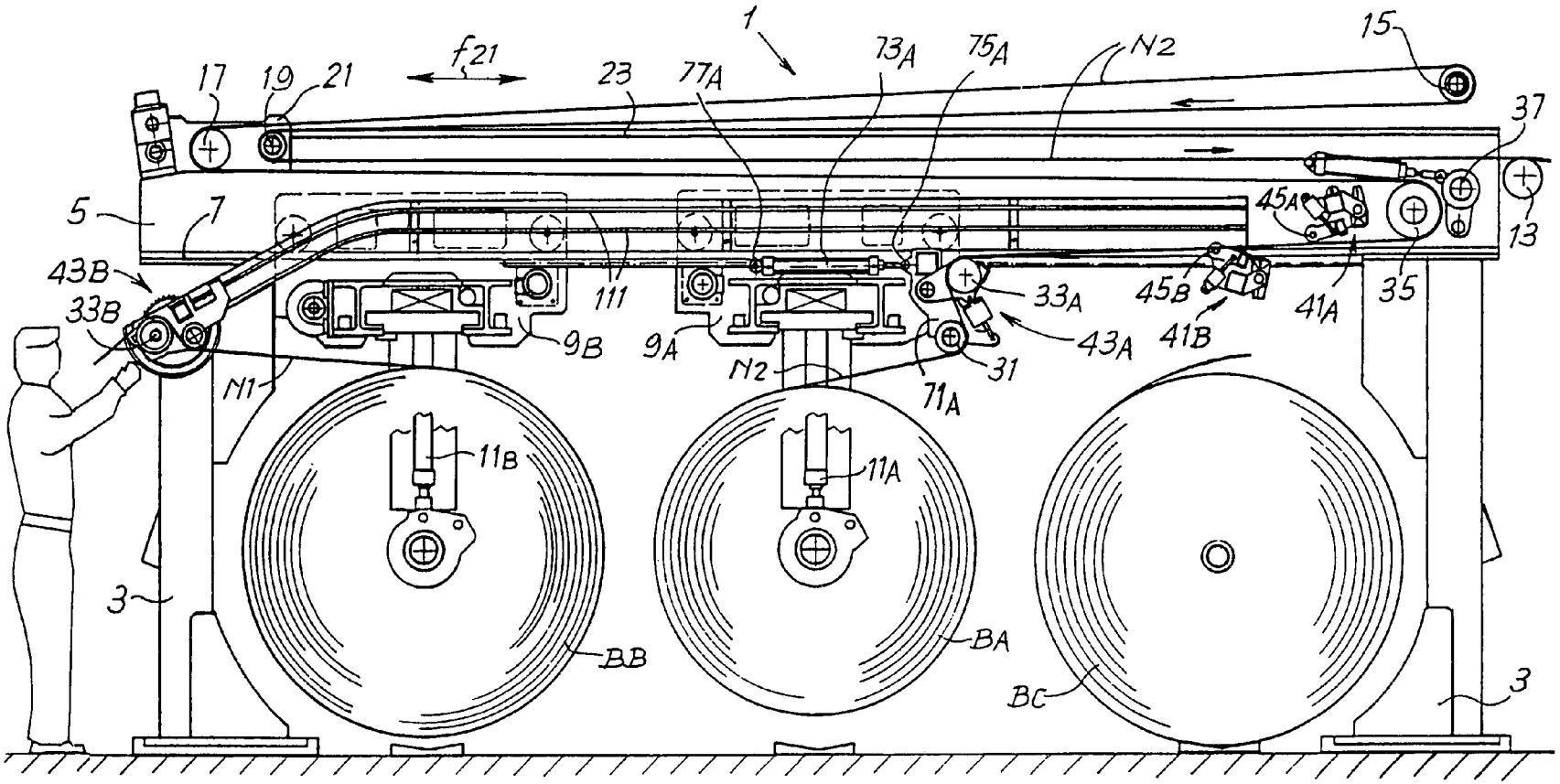
FIGS. 2, 3, 4 and 5 show subsequent positions of an unwinder comprising a splicing device according to the invention.

With reference now to FIG. 2, in the phase of operation illustrated here, three reels, indicated with BA, BB and BC, are located on the unwinder. The reel BA is in a central position inside the unwinder, carried by means 11A associated with the slide 9A. The reel BA is the one that supplies the web material, indicated with N2, towards the processing line during the phase shown in FIG. 2. The web material N2 follows a path defined by a roller 31 (supported with its axis fixed in relation to the slide 9A) and by a roller 33A carried by the slide 9A and oscillating around the axis 32A of the roller 31, for the purposes to be explained hereunder. The web material N2 is then driven around a motorized drive roller 35 against which a pressure roller 37 can press, through the effect of the action of a piston cylinder actuator. The purpose of the roller 35 is to accelerate the web material in the transitory phases to start feed from a new reel, as shall be better explained hereunder, and the pressure roller 37 prevents slipping between the web material and the accelerator roller 35. The pressure roller 37 could also be omitted.

Downstream of the roller 35 the web material forms a festoon being driven around the rollers 15, 17 and 19.

The reel BB is engaged by means 11B associated with the slide 9B and is in the preparation phase. This means that the initial edge of the web material N1 wound around said reel is prepared by the operator and fixed to a clamping bar of a head of the splicing device to be subsequently carried to a splicing position at the tail portion of the web material N2 coming from the reel BA. The reel BB will start to unwind when the reel BA comes to an end or in any case when it must be replaced. For example the two reels BA and BB may be reels of different material and replace each other when a change in the production order occurs.

BC indicates a third reel standing by which will start to be used in place of the reel BB in a subsequent phase of processing.

The splicing device, which forms the specific object of the present invention, comprises two heads each of which is comprised of two portions which may adopt different reciprocal positions. In the drawing 41A and 43A indicate as a whole the two portions of the first head of the splicing device (indicated as a whole as head 41A, 43A), while 41B and 43B indicate the two portions of the second head (indicated as head 41B, 43B) of the splicing device. The two heads are more or less identical except for the different spatial arrangement and some structural characteristics of secondary importance. Therefore, only one of these (head 41A, 43A) shall be described in particular detail hereunder also as regards its operation, while the conformation of the head 41B, 43B is described briefly with reference only to FIG. 8.

The two portions 41A and 41B of the two heads are hinged around respective axes 45A and 45B. For reasons that shall become more apparent hereunder, while the axis 45A around which the portion 41A of the first head oscillates may be fixed in relation to the crosspiece 5, the axis 45B of oscillation of the portion 41B of the second head is provided with a translatory movement to move the portion 41B from the position in FIGS. 2 and 3 to the position in FIGS. 4 and 5.

The oscillatory movement of the two portions 41A, 41B around the axes 45A, 45B is controlled by a piston-cylinder actuator indicated with 47A for the portion 41A of the head 41A, 43A and with 47B for the portion 41B of the head 41B, 43B.

The configuration of the portions 41A, 43A of the first head of the splicing device shall now be described with reference to FIG. 6A, where these two portions are in the reciprocal position adopted by them when the unwinder is in the position in FIG. 5, in a phase immediately prior to splicing of a first web material N1 being fed with a second web material N2 standing by.

The portion 41A of the first head of the splicing device has a moving unit 49A supported around the axis 45A and the oscillation of which around said axis is controlled by the aforesaid actuator 47A. The moving unit 49A supports oscillatingly around an axis 51A a counter-pressure member 53A with a cylindrical surface 55A, covered with a resilient material, cooperating with the roller 33A that is part of the portion 43A of the splicing head. The cylindrical surface 53A constitutes a portion of a straight circular cylinder, for example limited to an arc of 10–30°. This makes the counter-pressure member 53A particularly small in size and allows other members carried by the unit 49A to be placed in an optimum position for their operation, and in a limited space. In particular, the cutting member 67A may be placed in close proximity to the axis of oscillation 51A of the counter-pressure member 53A. In this way, as shall become apparent from the description hereunder of a splicing sequence of two web materials, the cut of the material may take place extremely close to the edge of the double-sided adhesive strip applied to the new web material and destined to splice together the tail edge of one web material and the leading edge of the other. This is advantageous as—as is known by those skilled in the art—it is advisable for excessively long free edges not to protrude from the edge of the double-sided adhesive strip. Moreover, it is also advisable for the double-sided adhesive strip not to be excessively wide, also in order to reduce the quantity of material used.

As can be seen in particular in FIGS. 6A–6L, the cutting member is tilted to form an acute angle with the portion of web material downstream of the cutting point, in relation to the direction of feed of the material. This makes operation of the device more efficient and reliable. In fact, even if the cutting member 67A, which is usually a toothed blade, has not cut the web material completely before splicing, subsequent drawing of the material does not cause it to disengage from the teeth of the blade. On the contrary, these teeth hold it until it tears along the line of the cut made by the teeth of the blade. This ensures that the web material of the reel which is running out is in any case severed.

The axis 45A supports a pair of oscillating arms 57A carrying a crosspiece 59A with which a pad 61A is integral. The members 57A, 59A and 61A form a braking means, indicated as a whole with 63A, which during the splicing phase of the web materials N1 and N2 is used to clamp the web material N1. The braking means 63A is associated with an elastic member constituted, in the example shown, by a pneumatic spring 65A secured at one end to the oscillating arms 57A and at the opposite end to the moving unit 41A. The moving unit 49 also carries a cutting member 67A to cut the web material N1. Finally, 69A indicates an adjustable stop secured rigidly to the moving unit 49A.

Figure 6A:
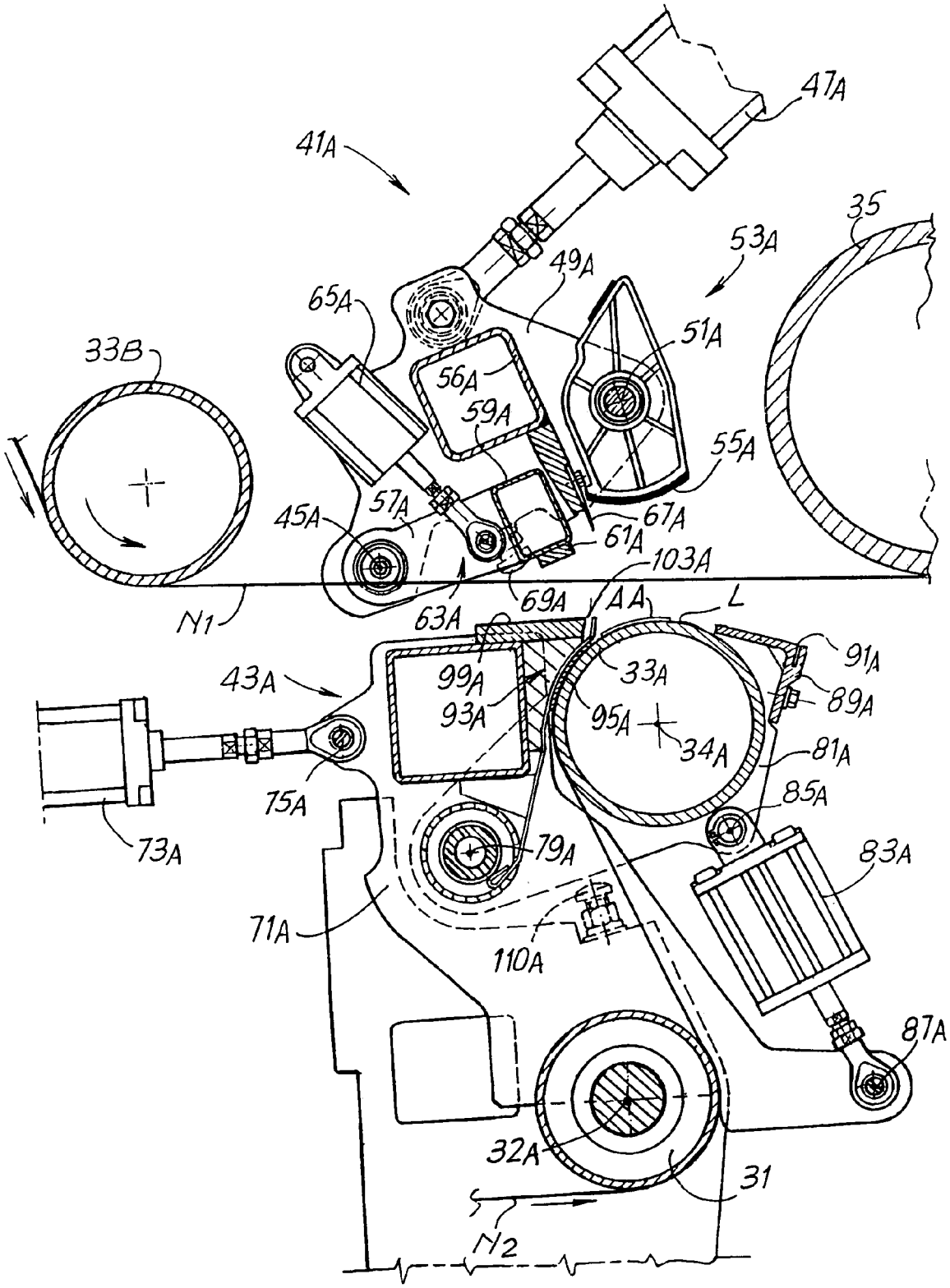
FIGS. 6A–6J show a sequence of phases of the splicing operation of two web materials, with reference to one of the two heads of the splicing device.

Again with reference to the parts visible in FIG. 6A, the portion 43A of the head 41A, 43A of the splicing device has a moving support 71A, hinged around the axis 32A of the roller 31 mentioned above, said axis being carried by the slide 9A. The oscillating movement of the moving support 71A is controlled by a piston-cylinder actuator 73A hinged in 75A to the moving support 71A and in 77A to the slide 9A. Hinged around an axis 79A carried by the support 71A are a pair of oscillating arms 81A which support the aforesaid roller 33A, the axis of which is indicated with 34A. Associated with the pair of oscillating arms 81A and consequently with the roller 33A supported idle by said arms is a piston-cylinder actuator 83A, which has the dual function of actuator member and elastic member, as shall become apparent hereunder. The piston-cylinder 83A is secured in 85A to the oscillating arms 81 and in 87A to the moving support 71A. Also rigidly secured to the oscillating arms 81A is a section bar 89A defining a channel 91A to trim the initial edge of the web material N2 when it is prepared for subsequent splicing to the web N1. This is a manual operation and is per se known.

The moving support 71A supports, rigidly secured to it, a clamping bar 93A cooperating with the roller 33A, the structure of which is shown in detail in FIG. 7. The clamping bar 93A has a series of pads made of rubber or another elastomer or similar material, indicated with 95A. Elastic plates 97A, made of metal or another suitable material, are inserted between them. The purpose of the pads 95A and the plates 97A is to hold, by pressing against the cylindrical surface of the roller 33A, the leading edge of the web material N2 positioned for splicing with the tail edge of the web material N1.

Disposed above the pads 95A and the plates 97A is an element parallel to the extension of the clamping bar 93A defining a surface 99A with which the pad 61A of the braking means 63A cooperates to clamp the web material N1 during the phase to cut and splice it with the web material N2. The section bar forming the surface 99A also defines, together with a section bar 101A, a counter-blade or cutting channel 103A cooperating with the cutting member 67A carried by the moving unit 49A of the portion 41A of the head 41A, 43A.

The second head of the splicing device, formed by the portions 41B, 43B has a substantially identical conformation. The two portions 41B, 43B of the second head are shown in FIG. 8, in the position they adopt when the unwinder is in the position in FIG. 3 ready to splice a web N2 being supplied to a web N1 standing by. Identical or equivalent parts to those of the first head 41A, 43A of the splicing device are indicated with the same reference numbers followed by the letter B instead of the letter A.

With reference now to FIGS. 2 to 5 the various positions that the unwinder may adopt are illustrated and subsequently with reference to FIGS. 6A to 6J the cutting and splicing sequence of the web material N1 and N2 performed by the head 41A, 43A shall be illustrated in greater detail, from which the equivalent operating mode of the head 41B, 43B shall also be apparent.

As indicated above, in FIG. 2 the unwinder is in an operating phase in which a web material N2 is supplied from the reel BA in the central position towards the corrugated cardboard production line, while the web material N1 is prepared by the operator who trims the initial edge and clamps it on the portion 43B of the head 41B, 43B of the splicing device.

For this purpose the portion 43B of the head of the splicing device has been taken to the position shown in FIG. 2 moving it along guides 111 carried by the crosspieces 5. The roller 33B is moved away from the clamping bar 93B by the piston-cylinder actuator 83B to facilitate insertion by the operator of the leading edge of the web material between the roller and the bar. Once this operation has been performed, the piston-cylinder actuator 83B presses the roller 33B against the clamping bar 93B to hold the web material between the roller and the pads 95B. In this position the operator can trim the web material with a knife cutting it along the cutting channel 91B. In close proximity to the edge obtained by the cut he then applies a strip of double-sided adhesive AA. After the operator has trimmed the initial edge of the web material, and applied the strip of double-sided adhesive material to it, the piston-cylinder actuator 83B moves the roller 33B back slightly from the pads 95B, to an extent that the web material is still held between the roller and the elastic plates 97B. This allows the operator to rotate the reel BB slightly in the rewinding direction until the edge of the web material and the strip of double-sided adhesive material AA are as close as possible to the channel or counter-blade 103B. Upon reaching this position the piston-cylinder actuator 83B is again taken to press the cylinder 33B with greater force against the clamping bar 93B to hold the leading edge of the web material between the roller 33B and the pads 95B. With these operations a free leading edge can be produced, positioned extremely close to the counter-blade 103B and the double-sided adhesive strip can practically be applied to the edge of the material, to obtain a high quality splice.

Figure 3:
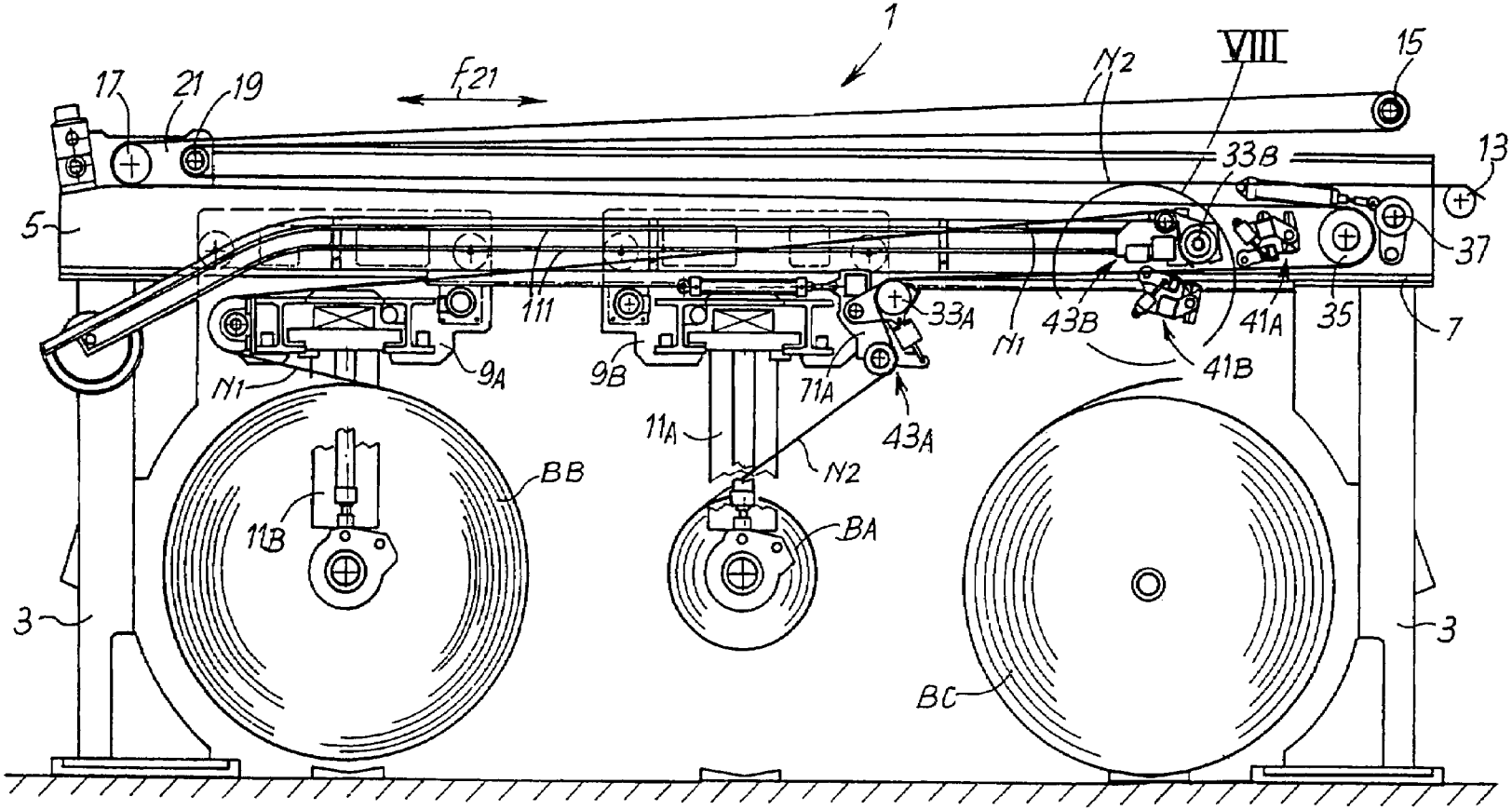

In the subsequent FIG. 3 it can be seen how the reel BA is still in the operating position. It supplies web material N2 along the path defined above with reference to FIG. 2. Its diameter is reduced due to the fact that the web material wound on it has already been partly supplied to the processing line.

Preparation of the leading edge of the web material N1 coming from the reel BB has been terminated and this edge has been carried from the portion 43B of the head 41B, 43B of the splicing device to the position shown in FIG. 3, close to the delivery zone of the web material towards the processing line. For this purpose the portion 43B of the head of the splicing device has been made to rotate and translate along the guides 111 carried by the crosspieces 5 of the fixed structure of the unwinder.

When the reel BA has come to an end or in any case must be replaced with the reel BB, the head 41B, 43B of the splicing device performs a cutting and splicing operation, identical to the one described hereunder with reference to the head 41A, 43A. After performing this operation the unwinder reaches the position in FIG. 4. For this purpose the reel BA that has come to an end is released by the means 11A carried by the slide 9A to removal means (for example a conveyor belt) disposed in the central zone of the unwinder, under the position of the reel BA in FIG. 3.

Figure 4:
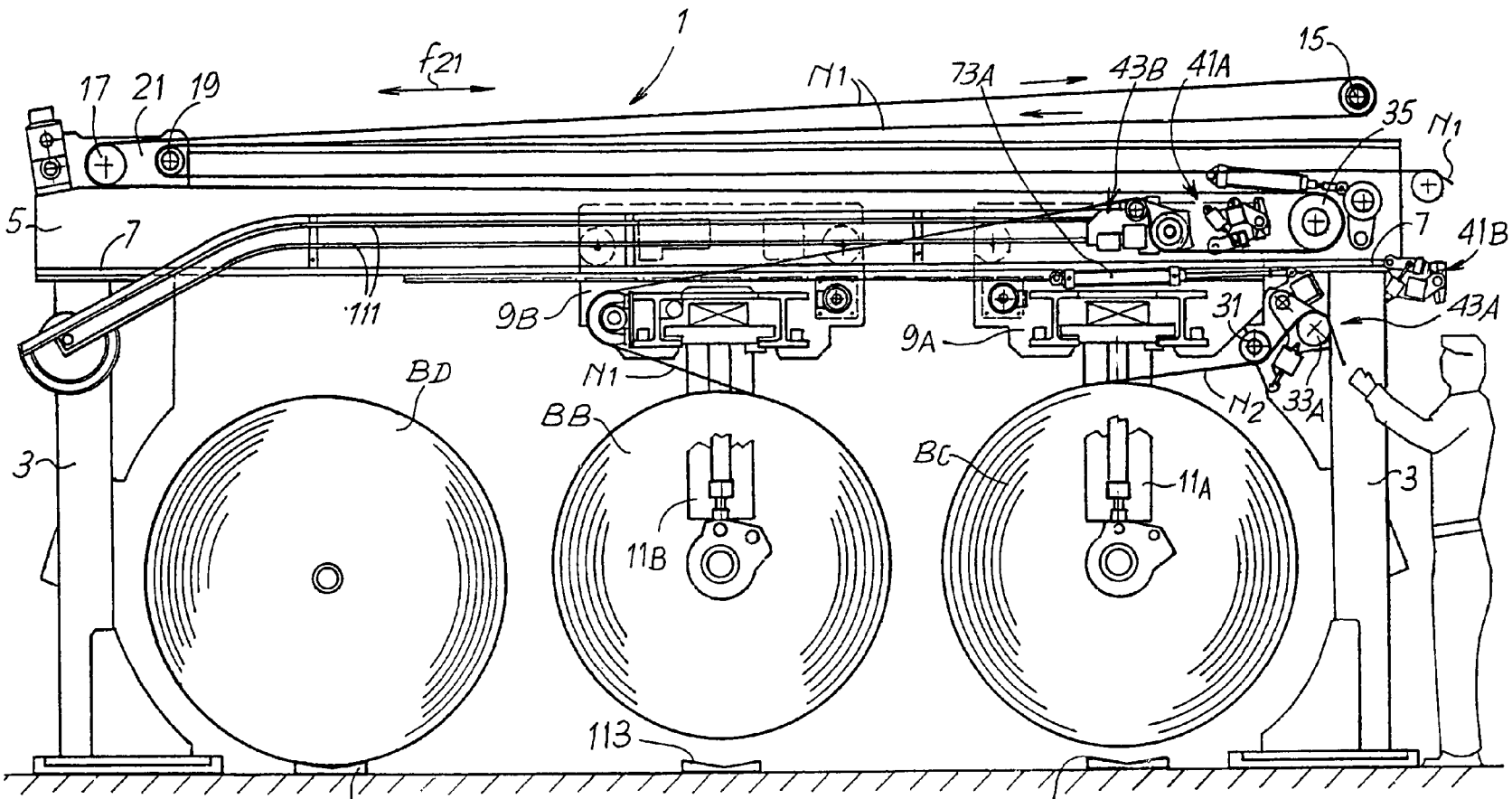

After the reel BA has been unloaded, the two slides 9A and 9B are made to translate to adopt the position in FIG. 4. The slide 9A is thus in the position to the right in the drawing to engage the reel BC which is standing by.

The slide 9B is now in the central position and supports the reel BB from which the web material N1 is now supplied to the production line downstream. The position on the left in FIG. 4 shows a new reel BD that has been placed in the unwinder.

As can be seen in FIG. 4, the portion 41B of the head 41B, 43B of the splicing device has in the meantime been moved (at a suitable moment after processing of the web material N1 has started) to the position shown on the right in FIG. 4, so that it does not interfere with the portion 43A of the head 41A, 43A.

The portion 43A of the first head of the splicing device is, in fact, translated from the position in FIG. 3 to the position in FIG. 4 being carried by the slide 9A, when this moves from the central position adopted in FIG. 3 to the side position in FIG. 4.

Moreover, in the position in FIG. 4 the portion 43A of the first head 41A, 43A of the splicing device has been made to oscillate clockwise around the axis 32A of the roller 31 by the piston-cylinder actuator 73A.

In this position of the portion 43A of the first head 41A, 43A of the splicing device the operator can position the free leading edge of a new web material, again indicated with N2, wound on the reel BC once this has been engaged by the means 11A and raised from the conveyor 113. For this purpose, the operations already described with reference to FIG. 2 and relative to preparation of the free leading edge of the web material N1 of the reel BB are performed by the operator.

Figure 5:
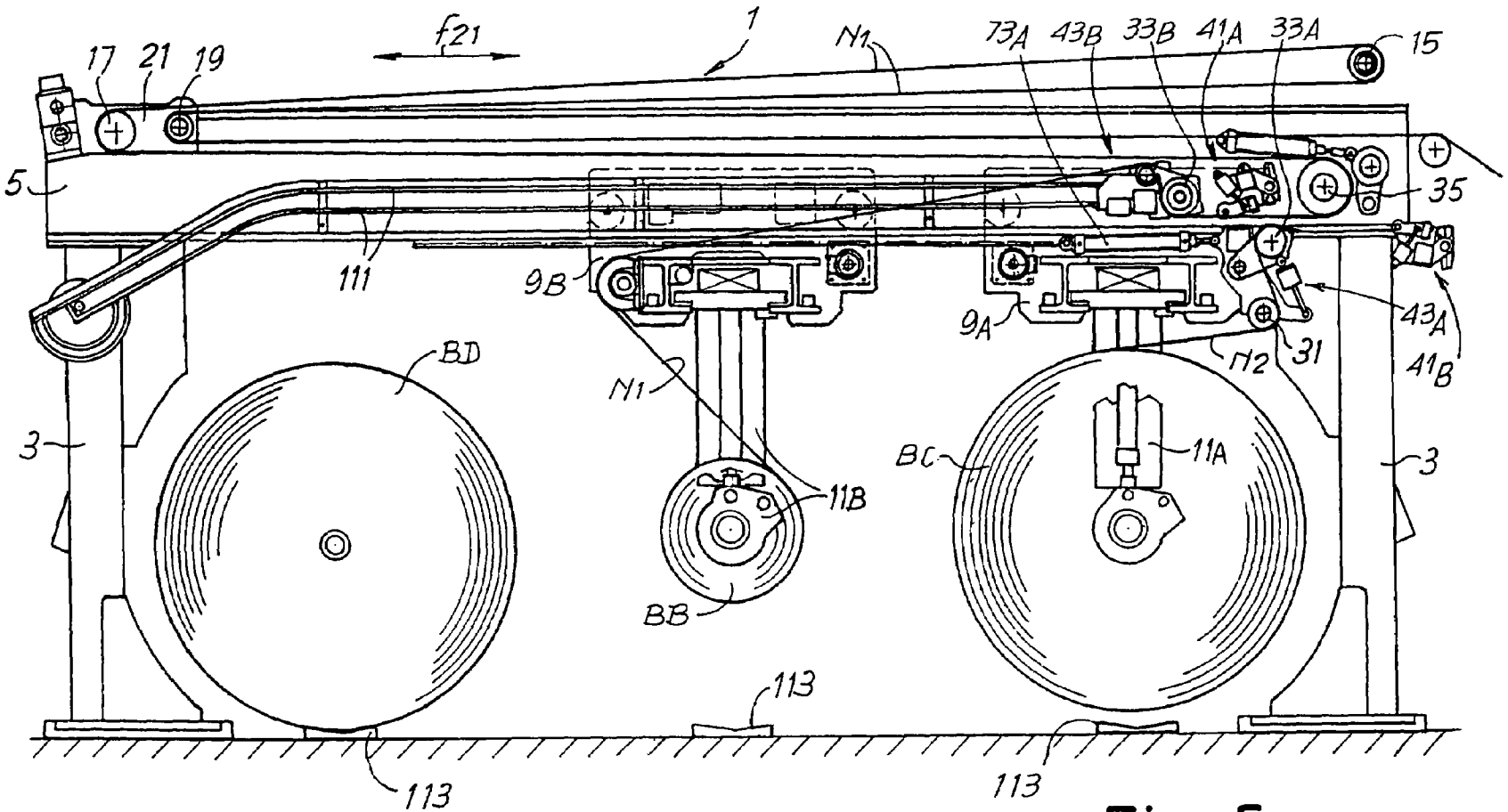

In FIG. 5 the unwinder is still in the position in FIG. 4 except for the different position adopted by the portion 43A of the head 41A, 43A of the splicing device. In fact, in FIG. 5 the portion 43A was made to oscillate by the piston-cylinder actuator 73A around the axis 32A of the roller 31 counterclockwise to adopt the cutting and splicing position. The reciprocal position of the portions 41A, 43A of the first head of the splicing device shown in FIG. 5 coincides with the position in FIG. 6A. This is the initial starting position of the splicing and cutting cycle which will now be described with reference to the sequence in FIGS. 6A–6J.

In FIG. 6A the web material supplied is again the material N1 coming from the reel BB which is in the central position of the unwinder (FIG. 5). The head 41A, 43A of the splicing device, which will start to operate to perform cutting and splicing in this phase, is disposed in an intermediate position between the accelerator roller 35 carried by the fixed structure 3, 5 of the unwinder and the roller 33B which forms part of the portion 43B of the second head 41B, 43B of the splicing device. The roller 33B, in this phase, acts as a driving roller for the web material.

The leading edge L of the web material N2 is held between the roller 33A and the clamping bar 93A. A strip of double-sided adhesive material AA has been applied to the end portion of this edge L in the way described hereinbefore. This strip of double-sided material is in the zone between the bar 93A and the cutting channel 91A, defined by the section bar 89 and along which the operator cut the web material N2.

Figure 6B:
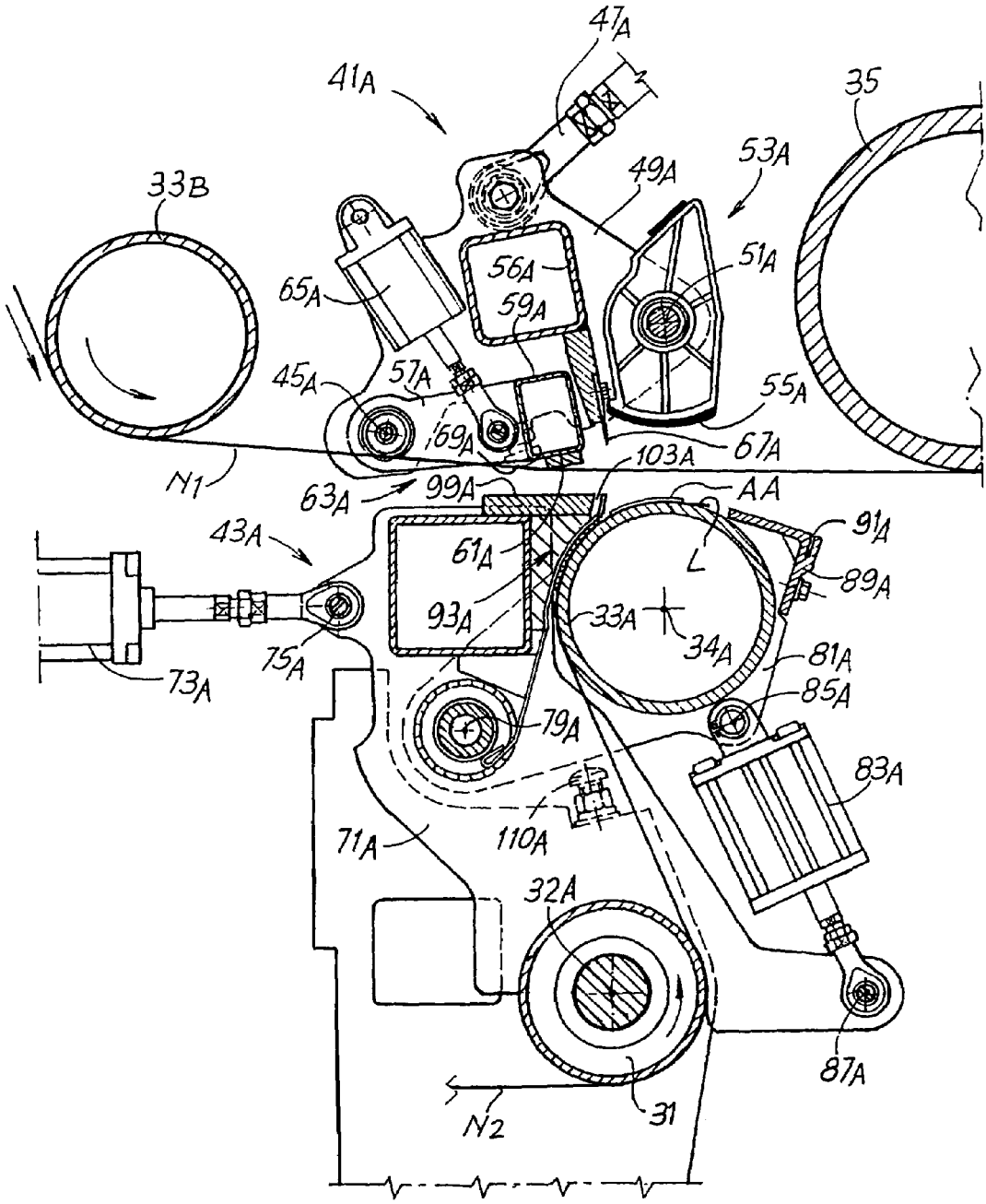

To cut the material N1 and splice the web materials N1 and N2 the moving unit 49A performs a clockwise oscillating movement controlled by the actuator 47A. FIG. 6B shows how the moving unit 49A has started its oscillating movement, having performed a rotation of about 15° in relation to the position in FIG. 6A. The pad 61A of the braking means 63A is now in contact with the web material N1 and pushes it towards the counter-pressure surface 99A. The feed speed of the web material N1 from the reel to the accelerator roller 35 is gradually reduced to almost zero with gradual slowing of the roller 35 and braking of the reel to prevent the material from slackening due to inertia of the reel. The speed of the web material downstream of the unwinder, that is the supply speed to the processing line, remains substantially unvaried thanks to the supply accumulated in the festoon defined by the rollers 35, 15, 17, 19, 21.

Figure 6C:
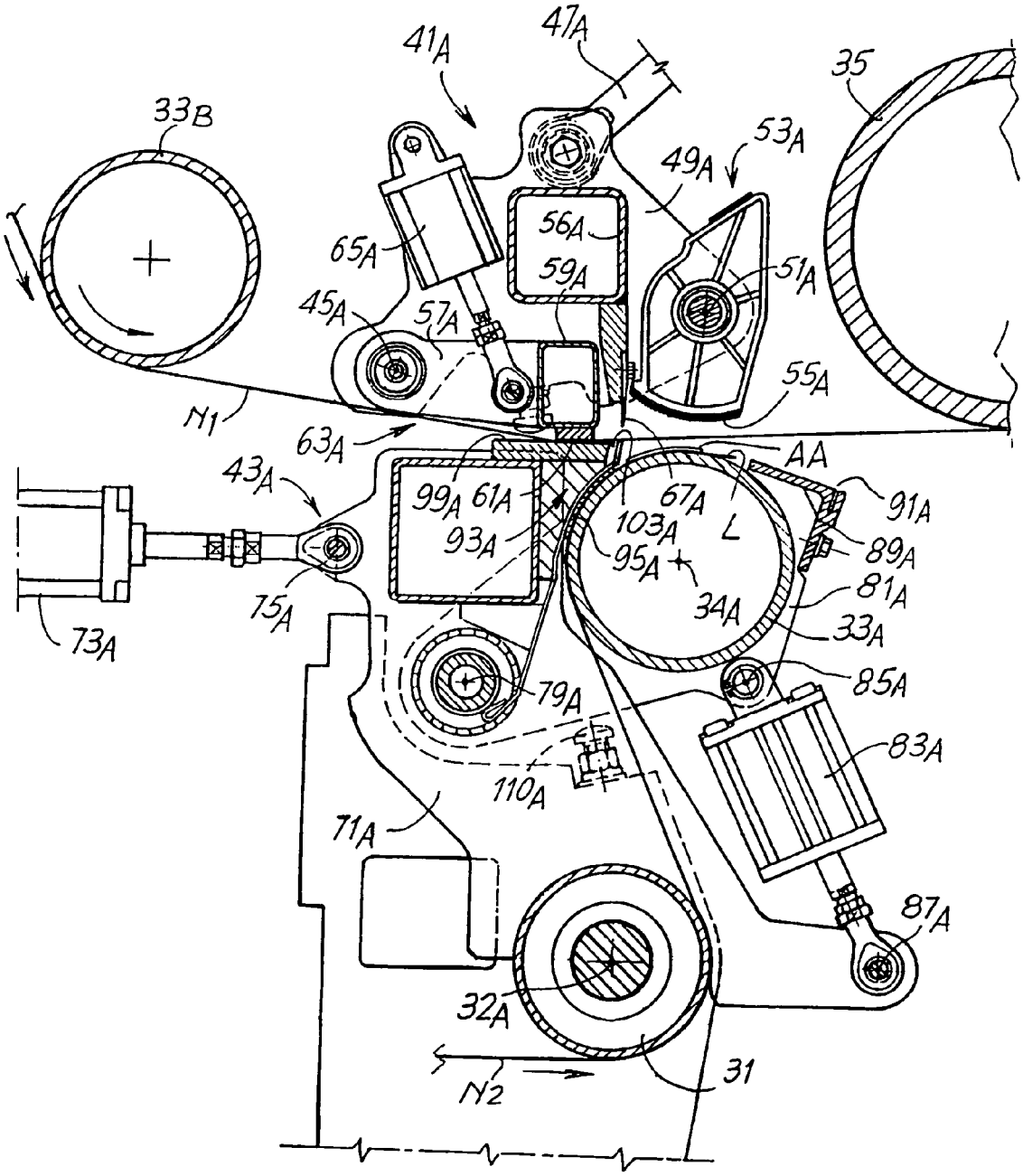

In the position shown in FIG. 6C the moving unit 49A has performed a further clockwise oscillating movement advancing by more or less another 4° around the axis 45A through the effect of the piston-cylinder actuator control 47A. In this position the pad 61A of the braking means 63A presses the web material N1 against the counter-pressure surface 99A clamping the web material N1. This is no longer supplied by the reel BB, which stopped previously. Feed of the material N1 to the production line is again guaranteed by the supply accumulated in the festoon defined by the driving rollers 15, 17, 19 and by the roller 35.

The slide 21 then moves from left to right (with reference to FIGS. 1 to 5) to feed the web material towards the delivery roller 13 and then towards the production line. This guarantees continuous feed and a substantially constant speed towards the machines downstream.

The oscillating movement of the moving unit 49A can continue thanks to the fact that the arms 57A can oscillate around the axis 45A against the effect of the elastic member 65A which holds the pad 61A pressed against the counter-pressure surface 95A.

Figure 6D:
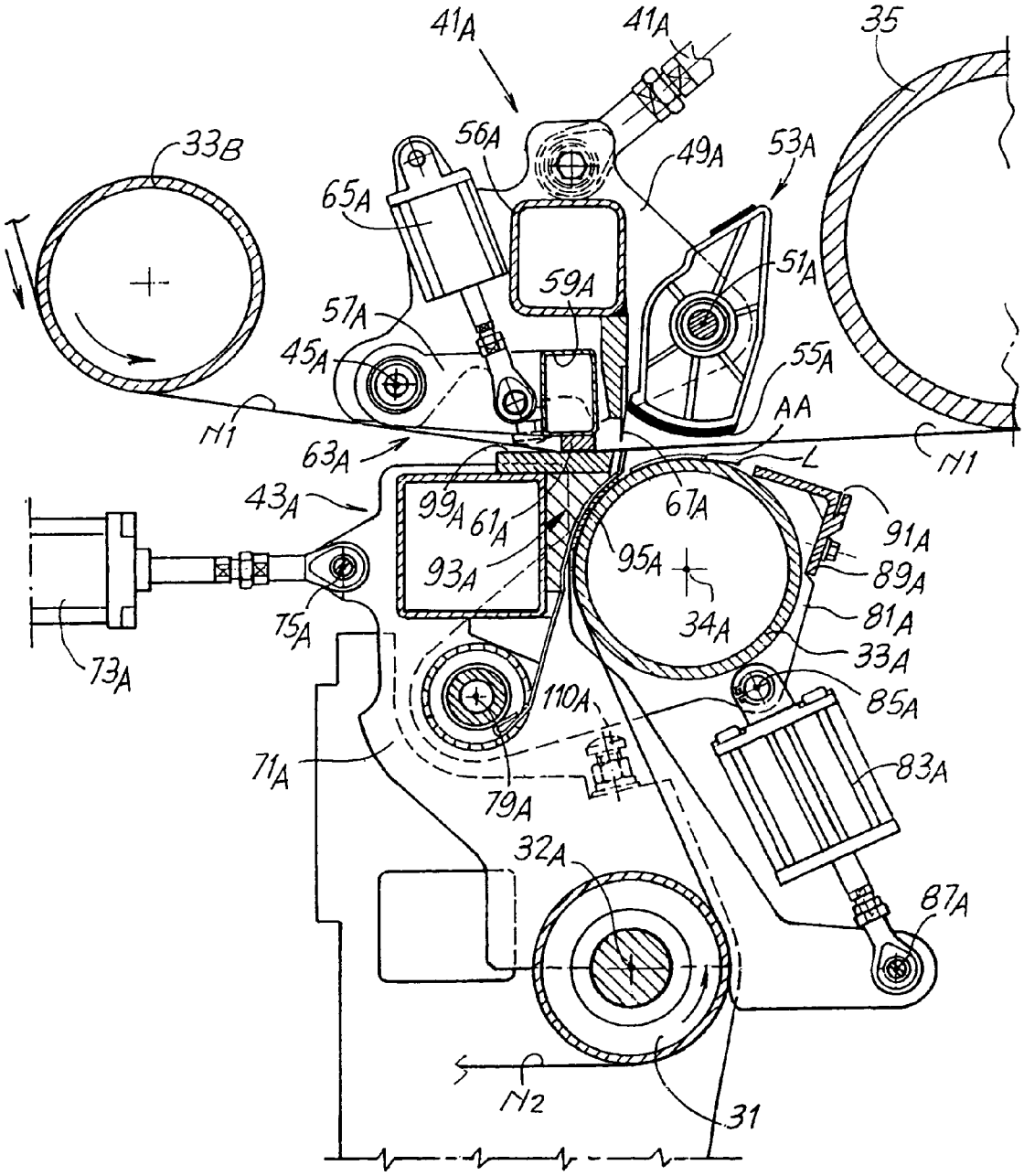

In FIG. 6D it can be seen how the moving unit 49A has performed a further downwards oscillating movement around the axis 45A moving the counter-pressure member 53A towards the roller 33A and the cutting member 67A towards the channel or counter-blade 103A. The web material N1 is still clamped.

Figure 6E:
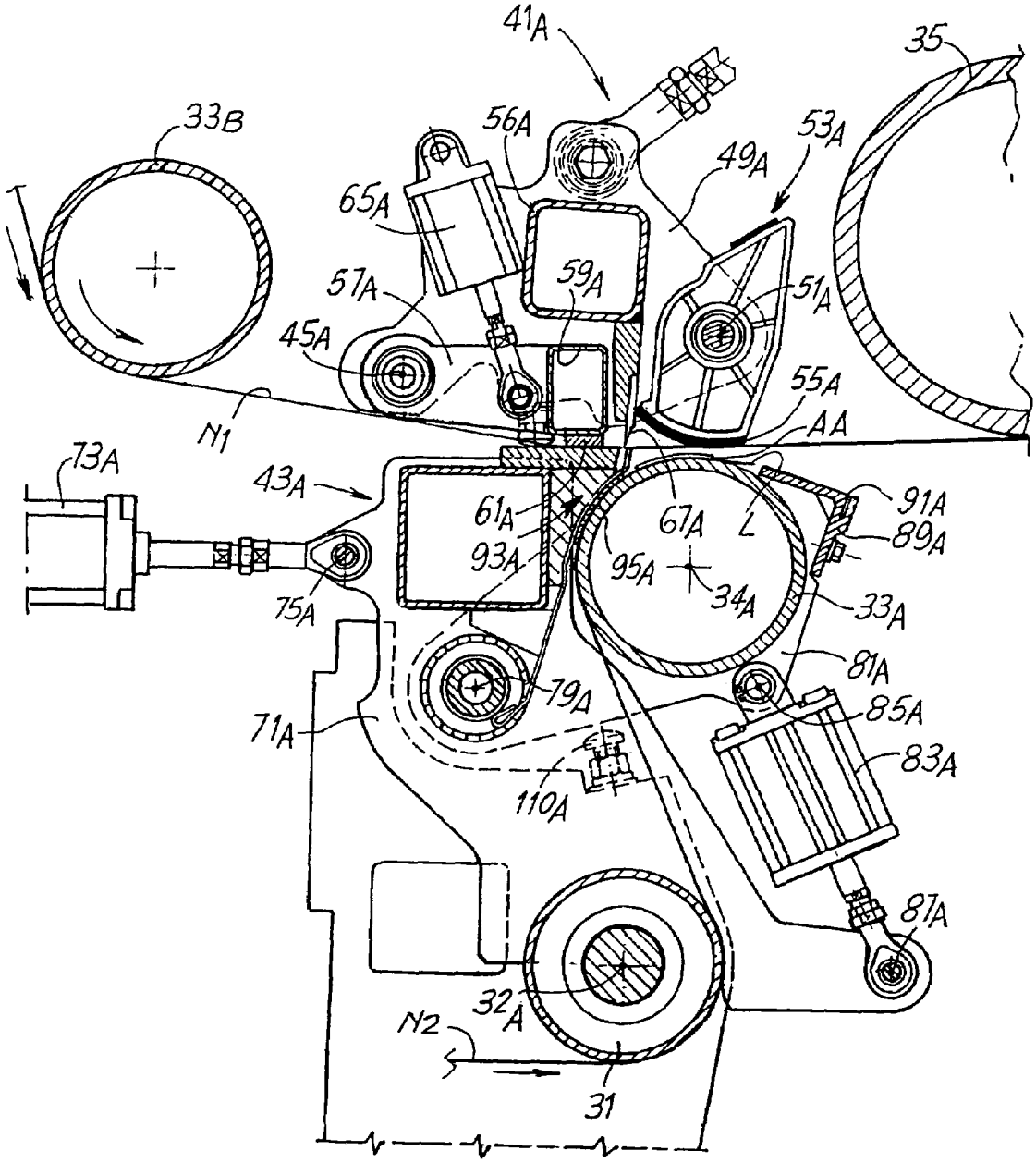

In FIG. 6E the moving unit 49A is in a position in which the cutting member 67A starts to penetrate the channel or counter-blade 103A cutting the web material N1. The cutting member 67A may have a serrated cutting edge, that is toothed, and/or inclined to facilitate penetration of the web material 1 and cutting the material.

Figure 6F:
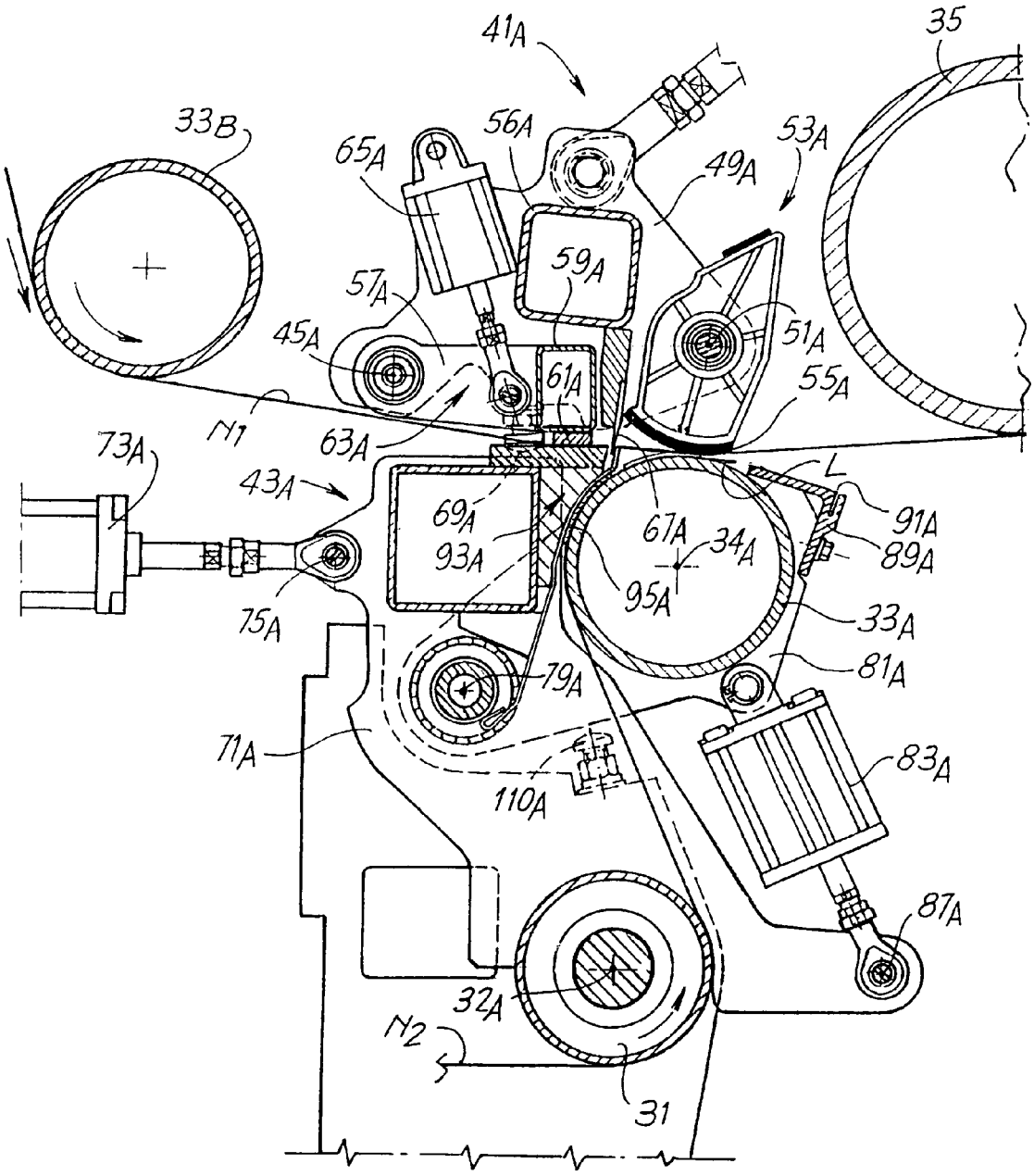

FIG. 6F shows how clockwise oscillation of the moving unit 49A continues to complete the cut of the web material N1 by the cutting member 67A, while the counter-pressure member 53A is carried with its cylindrical surface 55A to press against the cylindrical surface of the roller 33A.

Figure 6G:
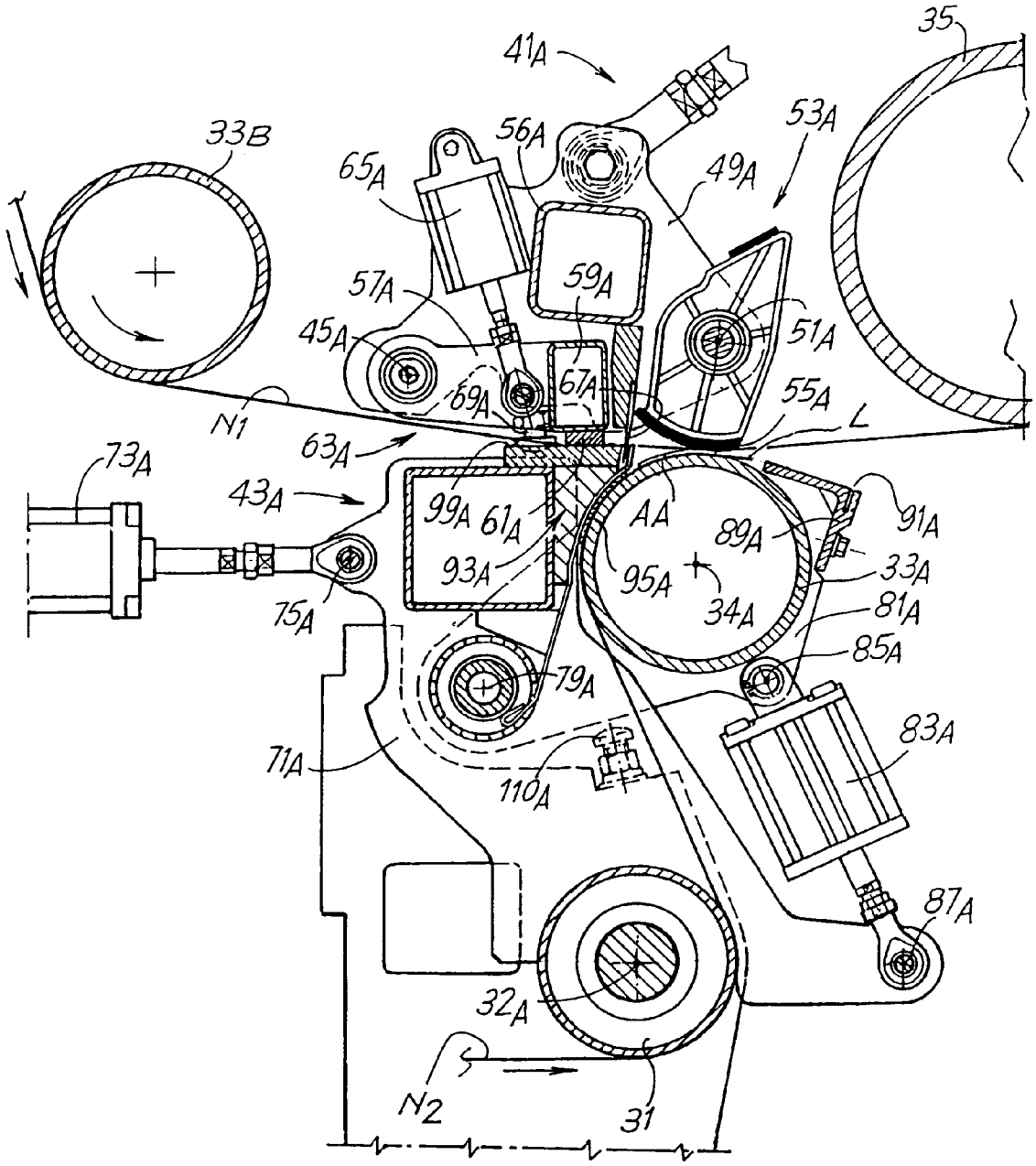

In FIG. 6G the tail of the web material N1 is pinched between the counter-pressure member 53A and the roller 33A. It is pressed against the strip of double-sided adhesive material AA, which was previously applied to the free edge. L of the web material N2 which is still held between the roller 33A and the clamping bar 93A.

Figure 6H:
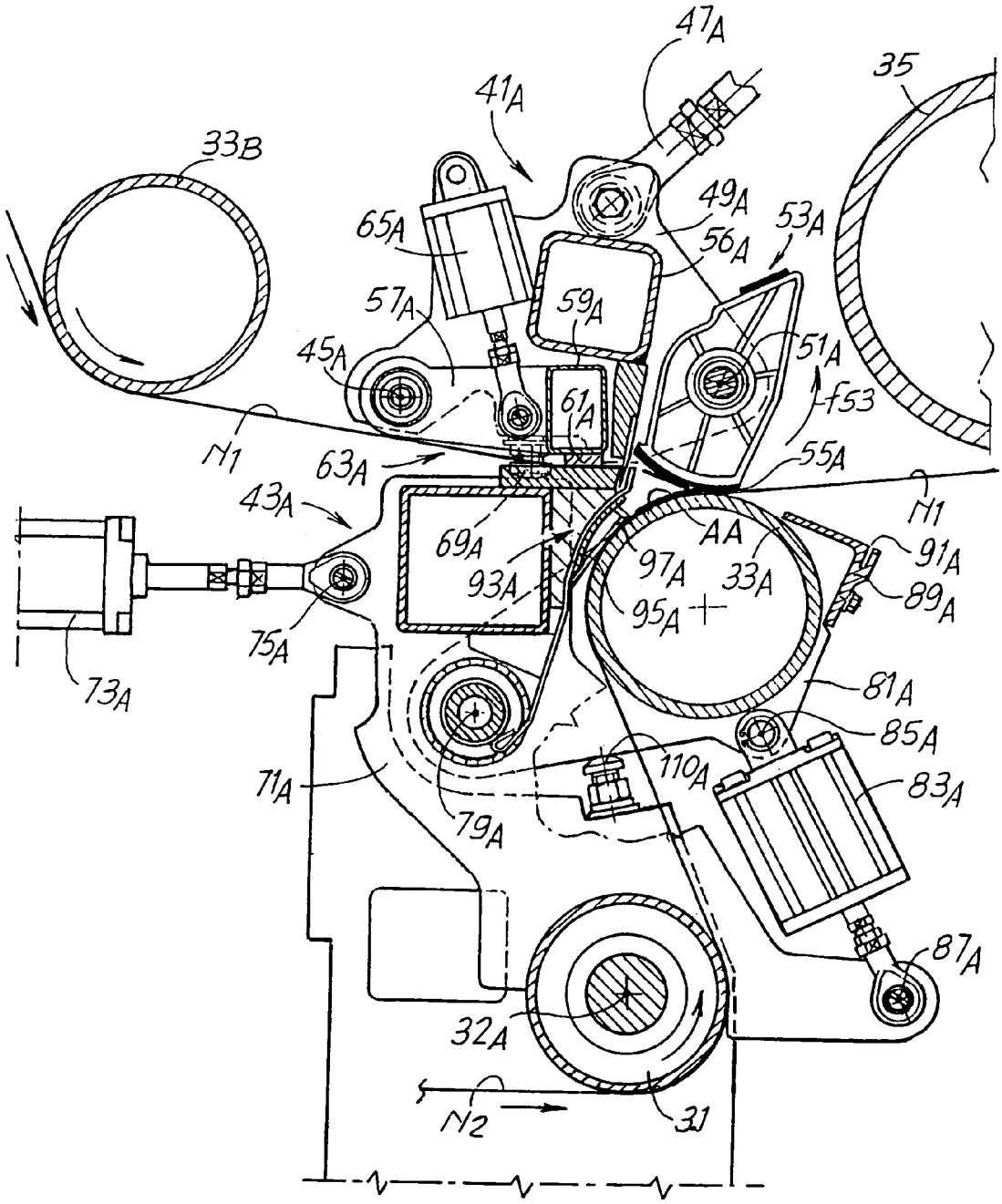

By further continuing clockwise oscillation of the moving unit 49A, the head of the splicing device adopts the position in FIG. 6H. It may be observed here that further lowering of the moving unit 49A has caused movement of the roller 33A, due a clockwise oscillation of the supporting arms 81A against the action of the piston-cylinder actuator 83A, which in this phase acts in substance simply as an elastic member. Oscillation of the arms 81A was caused by the thrust exerted by the counter-pressure member 53A. This oscillation of the arms 81A causes the cylindrical surface of the roller 33A to move away from the pads 95A of the clamping bar 93A, so that the web material N2 can be drawn in movement as described hereunder.

The moving unit 49A has reached its lowest position, the stops 69A now being in contact with the support 71A of the portion 43A of the head. The oscillating arms 81A supporting the roller 33A are also in their lowest position defined by stops 110A integral with the support 71A. Upon reaching this position the supply of web material N1 in the festoon defined by the rollers 15, 17 and 19 has almost come to an end and feed of the web material N2 must commence. For this purpose the acceleration roller 35 must be made to rotate pressing the pressure roller 37 (if present) against it.

This determines gradual acceleration of the tail of the web material N1 that draws with it the head of the web material N2. If the web material N1 has not been completely cut by the cutting member 67A, the drawing movement caused by the acceleration imparted by the accelerator roller 35 causes the tail of the web material N1 to tear and remain engaged by the teeth of the cutting member 67A, thanks to the inclination it takes up in this position.

As can be seen in FIGS. 6G–6H, thanks to the particular conformation of the counter-pressure member 53A, which is not constituted by a cylinder, but by a sector of cylinder, the cutting member 67A and the channel 103A are positioned very close to the position in which the strip of double-sided adhesive AA is located. In this way the web material N1 is cut in close proximity to the strip of double-sided adhesive material AA.

The traction exerted on the tail of the material N1 causes the roller 33A to start rotating clockwise around its axis and the counter-pressure member 53 to oscillate counter-clockwise according to the arrow f53 (FIG. 6H) around its axis of oscillation 51A. Consequently the counter-pressure member 53A will move from the position in FIG. 6H to the position in FIG. 6I while the tail of web material N1 will gradually leave the splicing zone leaving the roller 33A and drawing with it the free leading edge L of the web material N2 to which this tail adheres thanks to the strip of double-sided adhesive material AA. The pressure exerted by the counter-pressure member 53A against the roller 33A ensures that the two web materials N1, N2 are joined to each other through the strip of double-sided adhesive AA. Moreover, at least for a portion of its counter-clockwise oscillating movement, the counter-pressure member 53A holds the roller 33A pressed downwards, allowing the web material N2 to pass under the clamping bar 93A.

Counter-clockwise oscillation of the counter-pressure member 53A is limited by a stop against a beam 56A uniting the two sides of the moving unit 49A. When the counter-pressure member 53A has reached the position against the beam 56A, it no longer holds the roller 33A in a position sufficiently far from the bar 93A to allow the web material N2 to pass between said bar and the roller 33A. The withdrawn position of the roller 33A could be guaranteed as of now by the action of the piston-cylinder 83A which for this purpose is activated promptly to move the roller 33A away from the bar 93A.

Figure 6I:
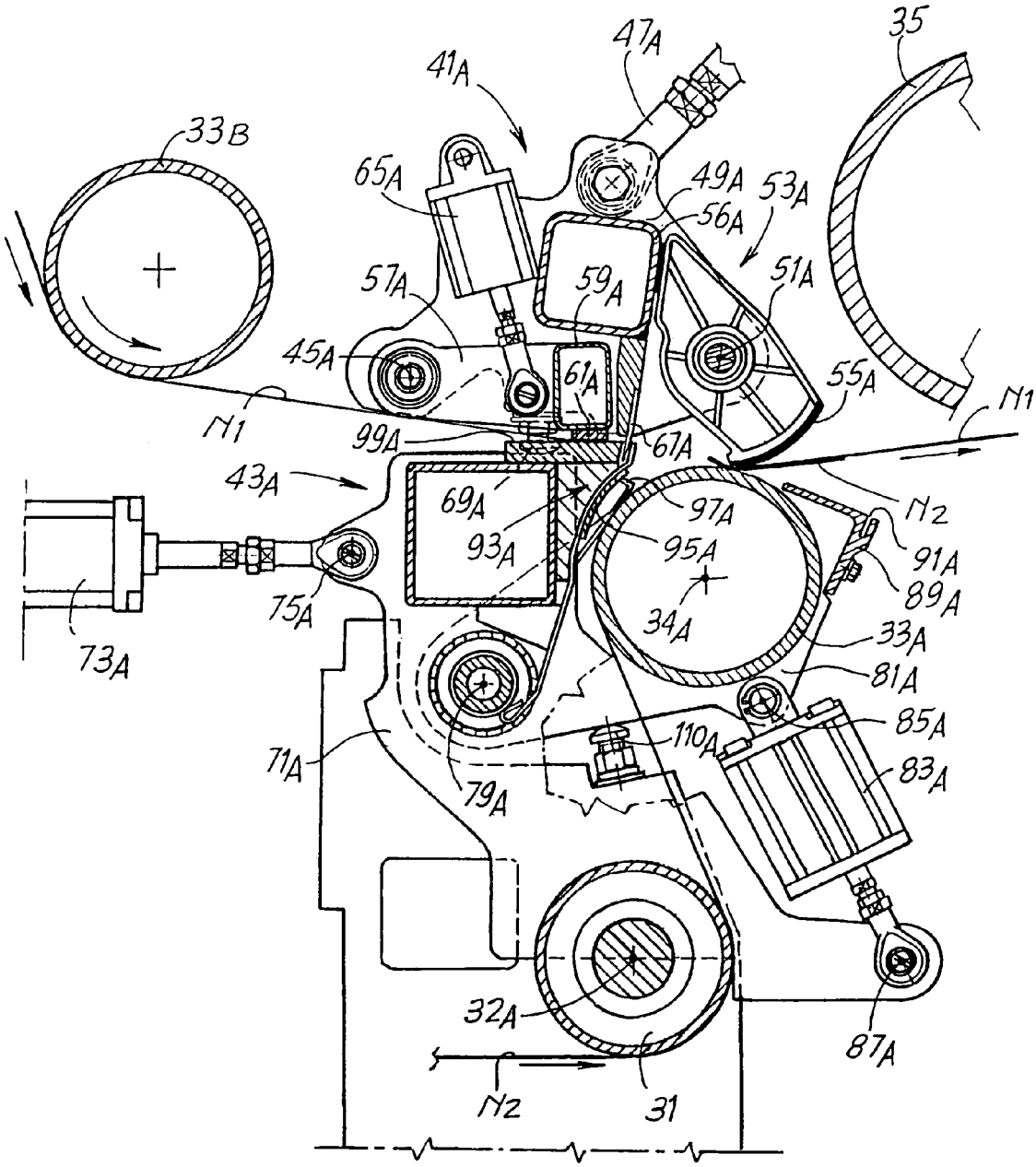
Figure 6J:
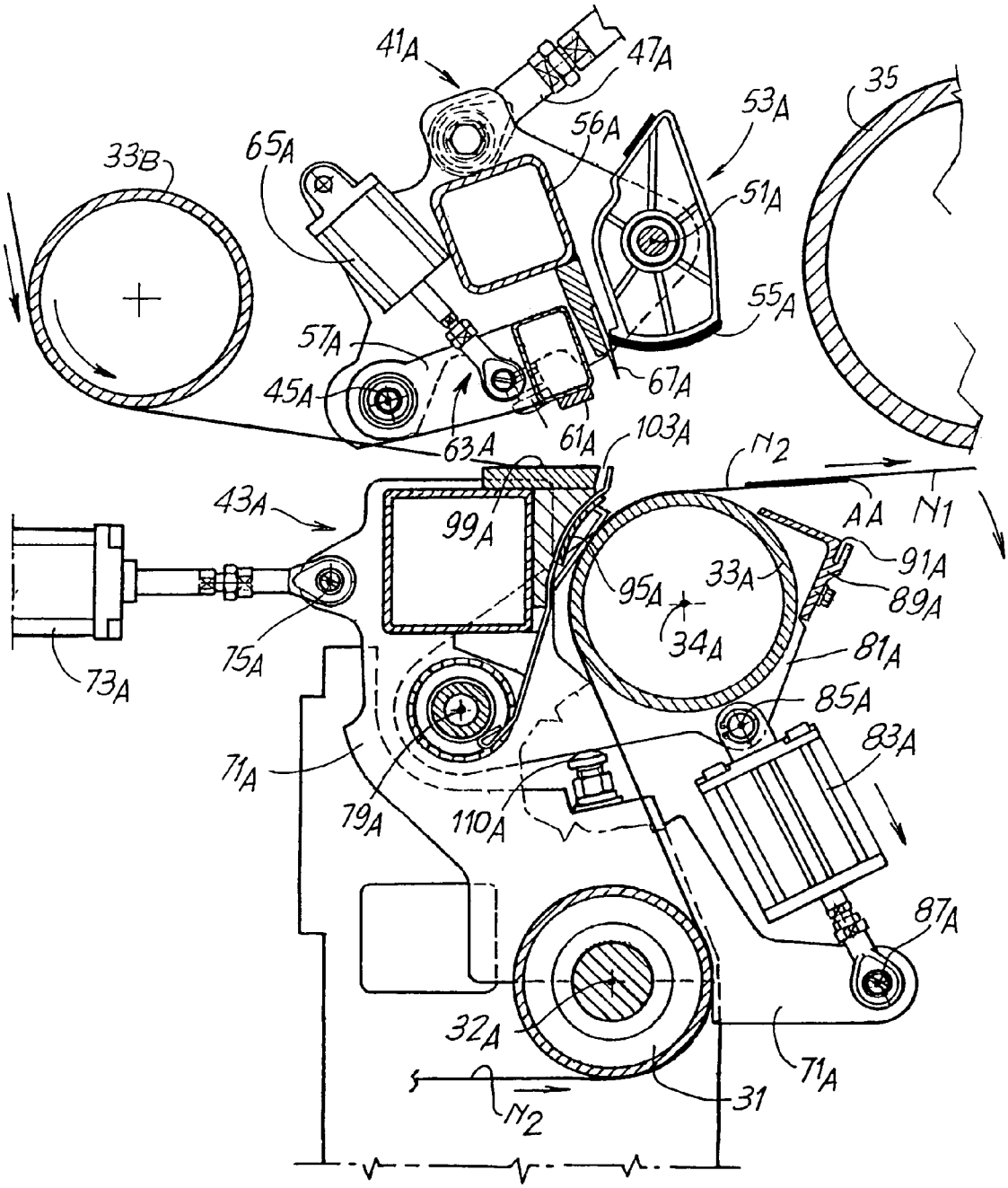
Figure 6K:
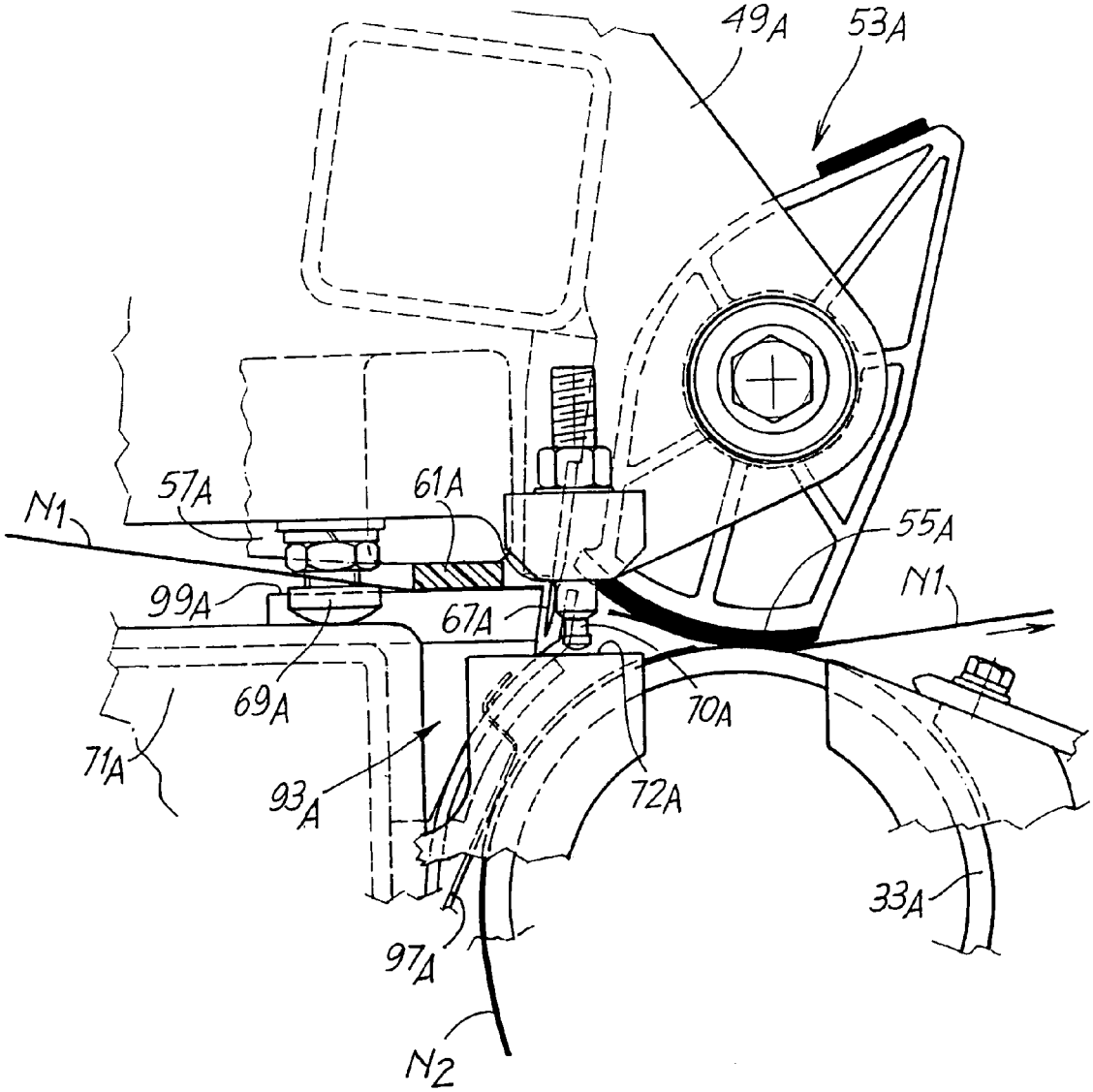
FIGS. 6K and 6L show two enlargements of the FIGS. 6H and 6I respectively.
Figure 6L:
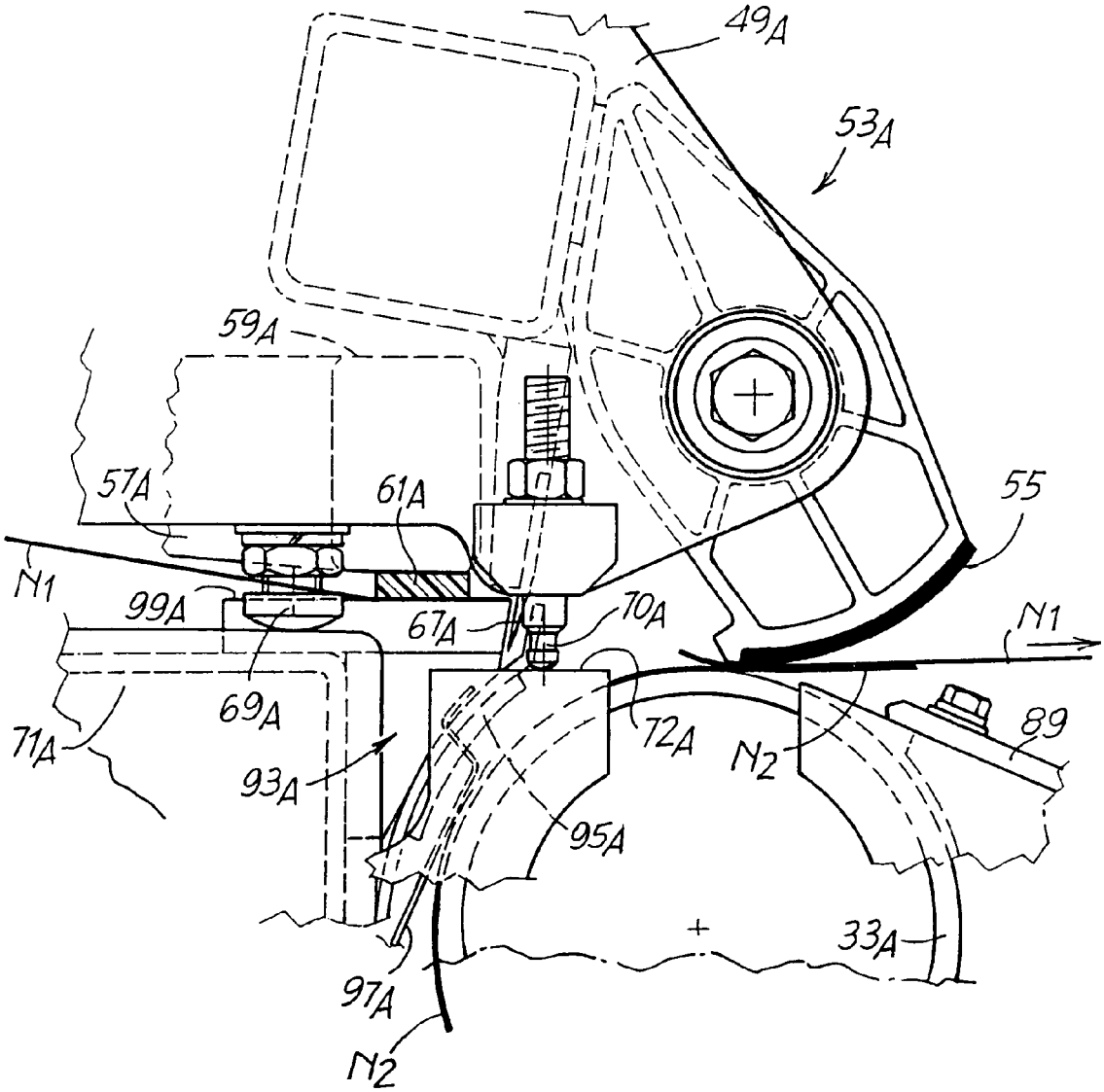

Nonetheless, in order to avoid having to activate the piston-cylinder 83A promptly, according to the embodiment shown an auxiliary stop 70A is provided integral with the portion 41A of the head 41A, 43A and shown only in the enlargements in FIGS. 6K and 6L, for the sake of clarity of the drawing.

As can be seen in FIG. 6K, when the head of the splicing device is in the position in FIG. 6H, before the counter-pressure member 53A starts to oscillate counter-clockwise following the feed of the web material, the auxiliary stop 70A is not in contact with the portion 43A of the head, but is slightly removed from an abutting surface 72A integral with the oscillating supporting arms 81A.

On the contrary, when the counter-pressure member 53A is in its position of maximum counter-clockwise oscillation, shown in FIG. 6I (and in the corresponding enlargement in FIG. 6L), the auxiliary stop 70A is in contact with the abutment surface 72A and, as the portion 41A of the head is always held in the same angular position in FIG. 6H, this means that the roller 33A, carried by the oscillating arms 81A does not return to press against the pads 95A of the clamping bar 93A, but is at a sufficient distance to allow the web material N2 freedom to advance and the roller 33A to rotate around its axis. Approach of the portion 41B to the auxiliary stop 70A is determined by the elastic thrust of the piston-cylinder actuator 83A, which in this phase still acts as an elastic member.

This position may be maintained even for a very long period of time, during which complete retraction of the piston-cylinder actuator 83A may be activated with an appropriate delay. This ceases to act as a simple counter-pressure spring and takes the roller 33A, with the oscillating arms 81A supporting it, to a withdrawn position in respect of the bar 93A.

At this point the head of the splicing device can reach the position shown in FIG. 6J. In this figure withdrawal movement of the roller 33A caused by retraction of the piston-cylinder actuator 83A is still in progress; this circumstance is represented by the arrows in the drawing. It should, however, be understood that raising of the portion 41A of the head 41A, 43A may be delayed until the movement by the piston-cylinder actuator 83A to withdraw the roller 33A has been completed.

When the portion 41A is raised the counter-pressure member 53A returns to the initial position with the aid of an elastic return member, for example a spiral spring coaxial to the axis of oscillation, or in another suitable way. The splicing zone between the web material N1 and the web material N2 continues to advance and is now positioned between the roller 33A and the acceleration roller 35.

The position in FIG. 6J differs from the initial position in FIG. 6A in substance only for the fact that the roller 33A does not press against the clamping bar 93A. In this way, the web material N2 can pass freely through the space between the bar 93A and the roller 33A and supply the production line downstream. It can, however, in the event of need be braked or clamped by activating the piston-cylinder actuator 83A.

As feed of the material N2 from the reel BC has started (FIG. 5) the slides 9A and 9B of the unwinder can translate to again adopt the position in FIG. 2. In this position the operator can place the free edge of a new web material on the portion 43B of the head 41B, 43B and prepare the unwinder and the splicing device to perform, through the head 41B, 43B, a new cutting and splicing cycle which will be substantially specular to the one described with reference to FIGS. 6A–6J performed by the head 41A, 43A.

From the description it is apparent how the entire splicing and cutting operation can take place extremely rapidly, therefore allowing the unwinder and production line downstream to reach high production speeds, without the risk during the splicing and cutting operations of the supply of web material contained in the festoon above the reel being unwound coming to an end in advance. Moreover, the structure of the splicing device is particularly simple and hence its operation reliable, thanks to the fact that the entire splicing and cutting cycle is performed operating a single actuator (the actuator 47A in the case of the head 41A, 43A). The other actuators required to move the various members of the splicing device act with much longer times and their action does not require to be executed in the very short period of time available to splice the two web materials.

It is understood that the drawing only shows an example provided purely as a practical demonstration of the invention, and said invention may vary in forms and arrangements without however departing from the scope of the concept underlying the invention. Any reference numbers in the accompanying claims are provided to facilitate reading of the claims with reference to the description and to the drawing, and do not limit the scope of protection represented by the claims.

I claim:

1. A splicing device to splice a first web material, coming from a reel being fed, to a second web material, coming from a standing by reel, comprising two heads, each of which comprises:

a roller associated with a clamping bar to hold between said roller and said clamping bar an initial edge of the second web material;

a counter-pressure member cooperating with said roller to press said first and second web materials against each other;

a cutting member;

wherein said counter-pressure member and said cutting member are carried by a moving unit controlled by an actuator which, through the movement the actuator imparts on said moving unit, causes the first and the second web material to be pinched between said roller and said counter-pressure member, the first web material to be cut by said cutting member and the second web material to be released by a movement of said roller in respect of said clamping bar, the roller being pushed by said counter-pressure member and removed from the clamping bar.

2. Splicing device as claimed in claim 1, wherein braking means are disposed on said moving unit to hold the first web material during cutting, said actuator also controlling clamping of the first web material through said braking means.

3. Splicing device as claimed in claim 1, wherein the moving unit of each of said heads is provided with an oscillating movement around a first axis of oscillation, controlled by said actuator.

4. Splicing device as claimed in claim 2, wherein the moving unit of each of said heads is provided with an oscillating movement around a first axis of oscillation, controlled by said actuator.

5. Splicing device as claimed in claim 3, wherein the counter-pressure member of each of said heads is supported by said moving unit in an oscillating way around a second axis of oscillation, substantially parallel to said first axis of oscillation, and said counter-pressure member has a substantially cylindrical surface cooperating with said roller.

6. Splicing device as claimed in claim 4, wherein the counter-pressure member of each of said heads is supported by said moving unit in an oscillating way around a second axis of oscillation, substantially parallel to said first axis of oscillation, and said counter-pressure member has a substantially cylindrical surface cooperating with said roller.

7. Splicing device as claimed in claim 5, wherein said counter-pressure member has a surface, cooperating with said roller, constituted by a portion of a straight circular cylindrical surface with axis coinciding with the axis of oscillation of said counter-pressure member.

8. Splicing device as claimed in claim 6, wherein said counter-pressure member has a surface, cooperating with said roller, constituted by a portion of a straight circular cylindrical surface with axis coinciding with the axis of oscillation of said counter-pressure member.

9. Splicing device as claimed in any one of claim 2, 4, 6 or 8, wherein said braking means is movably supported on said moving unit.

10. Splicing device as claimed in claim 9, wherein said braking means comprise an oscillating arm hinged to said moving unit around an axis of oscillation, and said oscillating arm is associated with an elastic member.

11. Splicing device as claimed in claim 10, wherein said braking means is hinged around said first axis of oscillation, around which said moving unit oscillates.

12. Splicing device as claimed in any one of claim 2, 4, 6 or 8, wherein said braking means cooperates with a counter-pressure surface integral with said clamping bar.

13. Splicing device as claimed in one of claims 1 to 8, wherein said roller is supported by an oscillating arm associated with a stressing member which stresses the roller against said clamping bar.

14. Splicing device as claimed in claim 13, wherein said stressing member is a piston-cylinder actuator which acts, at least temporarily, as an elastic stressing member.

15. Splicing device as claimed in one of claims 1 to 8, wherein said moving unit is equipped with a stop cooperating with a stop surface integral with said clamping bar, to define a position of maximum approach of said moving unit to said clamping bar.

16. Splicing device as claimed in claim 15, wherein said moving unit is equipped with an auxiliary stop cooperating with said oscillating arms, to hold said roller detached from the clamping bar when the counter-pressure member moves away from its position of maximum approach to the roller.

17. Splicing device as claimed in one of claims 1 to 8, wherein a counter-blade cooperating with said cutting member is integral with said clamping bar.

18. Splicing device as claimed in claim 13, wherein said counter-blade is disposed adjacent to the counter-pressure surface with which said braking means cooperate.

19. Splicing device as claimed in one of claims 1 to 8, wherein said roller and said clamping bar of each head are carried by a moving support designed to adopt alternately a first operating position, in which the roller is in position to cooperate with said counter-pressure member, and a second position, to allow preparation and clamping of the free edge of the second web material.

20. Splicing device as claimed in claim 19, wherein said moving support is provided with an oscillating movement.

21. Splicing device as claimed in one of claims 1 to 8, wherein when said cutting member is in the position to cut the web material, said cutting member forms, with the direction of feed of the web material, an acute angle.

22. Splicing device as claimed in claim 21, wherein said cutting member comprises a serrated blade.

23. An unwinder comprising means to support and handle reels of web material and a splicing device according to one of claims 1 to 8.

24. Method for splicing together a first web material and a second web material, comprising:

providing two splicing heads, each splicing head including: a roller associated with a clamping bar, a counter-pressure member cooperating with said roller, and a cutting member in a vicinity of said counter-pressure member;

arranging a free leading edge of the second web material on the roller of a first one of said two splicing heads, clamping said free leading edge between said roller and the clamping bar corresponding therewith, with a strip of double-sided adhesive material applied to said free leading edge;

arranging the counter-pressure member opposite said roller corresponding thereto;

wherein, a single actuator provides:

a movement to approach and press the counter-pressure member against said roller to pinch between said counter-pressure member and said roller the first web material and the second web material with the strip of double-sided adhesive material between them;

a movement of the cutting member to cut the first web material;

and a movement of said roller in respect of said clamping bar to release said second web material, the roller being pushed by said counter-pressure member and removed from the clamping bar.

25. Method as claimed in claim 24, characterized by arranging a braking means in the vicinity of said cutting member and causing with said actuator a braking movement of said first web material by means of said braking means.

26. Splicing device as claimed in claim 17, wherein said counter-blade is disposed adjacent to the counter-pressure surface with which said braking means cooperate.

* * * * *